US007388568B2

(12) United States Patent
Koyama et al.

(10) Patent No.: US 7,388,568 B2
(45) Date of Patent: Jun. 17, 2008

(54) LIQUID CRYSTAL DISPLAY DEVICE AND ELECTRONIC APPARATUS USING THE SAME

(75) Inventors: Jun Koyama, Kanagawa (JP); Shingo Eguchi, Tochigi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 198 days.

(21) Appl. No.: 10/390,901

(22) Filed: Mar. 19, 2003

(65) Prior Publication Data

US 2003/0179173 A1 Sep. 25, 2003

(30) Foreign Application Priority Data

Mar. 19, 2002 (JP) ..... 2002-076472

(51) Int. Cl.
*G09G 3/36* (2006.01)

(52) U.S. Cl. ..... 345/95; 345/99

(58) Field of Classification Search ..... 345/87, 345/90, 92, 98, 100, 102, 103; 349/41–48
See application file for complete search history.

(56) References Cited

U.S. PATENT DOCUMENTS 5,049,865 A * 9/1991 Nakamura et al. ..... 345/60
5,990,998 A 11/1999 Park et al.
6,580,475 B2 6/2003 Yamazaki et al.
6,690,033 B2 2/2004 Yamazaki et al.
6,750,837 B1 * 6/2004 Kondoh ..... 345/97
6,825,488 B2 11/2004 Yamazaki et al.
7,023,021 B2 4/2006 Yamazaki et al.
7,027,074 B2 4/2006 Koyama
7,205,989 B2 4/2007 Nakajima
2001/0030322 A1 10/2001 Yamazaki et al.
2002/0044116 A1 * 4/2002 Tagawa et al. ..... 345/87
2003/0174153 A1 9/2003 Koyama

FOREIGN PATENT DOCUMENTS

EP 1 120 679 8/2001
JP 62094827 * 5/1987

OTHER PUBLICATIONS

Chinese Office Action (Application No. 03108252.1), dated Mar. 9, 2007 with full English translation.

* cited by examiner

*Primary Examiner*—Sumati Lefkowitz
*Assistant Examiner*—William L Boddie
(74) *Attorney, Agent, or Firm*—Fish & Richardson P.C.

(57) ABSTRACT

In a liquid crystal display device of the present invention, a source line is formed of a gate metal and a gate line is formed of a source metal for reduction of the number of masks, whereby deterioration of a liquid crystal on the gate line is prevented. During a period in which the liquid crystal display is not used, an inverse voltage for preventing deterioration of the liquid crystal is applied to it. In addition, when the gate line is scanned, a width of a start pulse inputted in a shift register for driving a gate line is increased to approximately ten times as large as an ordinary width to improve a duty ratio in an inverted period of the gate line.

68 Claims, 18 Drawing Sheets display period non-display period display period non-display period

LIQUID CRYSTAL DISPLAY DEVICE AND ELECTRONIC APPARATUS USING THE SAME

BACKGROUND OF THE INVENTION

1. Field of the Invention

The present invention relates to a display device, and in particular to a liquid crystal display device, which uses a thin film transistor (TFT) formed on a transparent substrate such as glass or plastics, and a driving method of the same. In addition, the invention relates to an electronic apparatus using the liquid crystal display device.

2. Description of the Related Art

In recent years, with the advance of the communication technology, cellular phones have been widely used. In future, transmission of moving images and transmission of a larger volume of information are expected. On the other hand, through reduction in weight of personal computers, those adapted for mobile communication have been produced. Information terminals called PAD originated in electronic notebooks have also been produced in large quantities and widely used. In addition, with the development of display devices, most of those information portable apparatuses are equipped with a flat panel display.

Moreover, in the recent technique, as a display device provided in them, an active matrix display device tends to be used.

In the active matrix display device, a TFT is arranged for each pixel and a screen is controlled by the TFT. Such an active matrix display device has advantages in that it is high in performance, image quality, and moving image responsiveness, and the like compared with a passive matrix display device. Therefore, it is expected that the main stream of a liquid crystal display device also shifts from passive to active.

In addition, in recent years, among active matrix display devices, manufacturing of a display device using low temperature polysilicon have been promoted. With the low temperature polysilicon, in addition to manufacturing a pixel, a driving circuit can be integrally formed around a pixel portion. Thus, since it is possible to realize compactness and high definition of a display device, the display device is expected to be more widely used in future.

An operation of a pixel portion of an active matrix liquid crystal display device will be hereinafter described. FIG. 3 shows an example of a structure of the active matrix liquid crystal display device. One pixel 302 is constituted by a source signal line S1, a gate signal line G1, a capacitance line C1, a pixel TFT 303, and a storage capacitor 304. However, the capacitance line is not always necessary if other wiring or the like can also be used as the capacitance line. A gate electrode of the pixel TFT 303 is connected to the gate signal line G1. One of a drain region and a source region of the pixel TFT 303 is connected to the source signal line S1, and the other is connected to the storage capacitor 304 and the pixel electrode 305.

A driving method of this pixel will be hereinafter described. When a signal voltage is inputted in the gate signal line G1 and the pixel TFT 303 is turned ON, a signal voltage is inputted from the source signal line S1 and an electric charge is stored in the storage capacitor 304. A voltage is applied to the pixel electrode 305 by this stored electric charge, and the voltage is applied between electrodes sandwiching a liquid crystal. An orientation of molecules of the liquid crystal changes in association with this applied voltage, and a transmitted light amount is controlled.

FIG. 4 shows a relationship between an applied voltage and a transmitted light amount. The applied voltage is changed in the range of $-V_m$ to $V_m$, whereby the transmitted light amount can be changed. Note that it is assumed that the transmitted light amount reaches a maximum transmitted light amount $T_{max}$ when the applied voltage is zero. Here, there is a problem in that, when an electric field is continuously applied in a fixed direction, ions accumulate on one side of a liquid crystal and the liquid crystal deteriorates instantly. Thus, it is a general practice to drive the pixel with an applied voltage of an inverted polarity every time a signal is written in the pixel.

FIG. 5 shows a relationship among a gate signal voltage, a source signal voltage, and a voltage applied to the liquid crystal at the time when this display device is driven. In this figure, an applied voltage to a liquid crystal in certain one pixel is shown with the attention paid to certain one gate signal line and certain one source signal line.

When a gate signal line is selected and a voltage is applied to a liquid crystal, an orientation of liquid crystal molecules changes in accordance with the applied voltage. Consequently, a transmitted light amount changes to display an image. Here, a voltage applied to the liquid crystal changes in the range of −V to V, and its polarity is inverted every time a signal is written in a pixel. Note that |V| is set to a value equal to or lower than |Vm| in FIG. 4.

FIG. 6A shows an example of a sectional view of a pixel portion of a conventional active matrix liquid crystal display device. A pixel TFT 102 and a storage capacitor 103 are formed in a pixel portion 101. Here, reference numeral 104 denotes an insulating substrate of a TFT substrate; 105, a source region or a drain region of the pixel TFT 102; 106, a channel region of the pixel TFT 102; 108, a gate insulating film; and 107 and 112, electrodes of the storage capacitor 103, which sandwich an insulating layer 109 between them. Note that the electrode 107 is formed of a semiconductor layer, and an impurity element is doped in the electrode 107. The electrode 107 is connected to the drain region of the pixel TFT 102. In addition, reference numeral 215 denotes a gate signal line; 210, a source signal line; 116, drain wiring; 113, an interlayer insulating film; 118, a pixel electrode; 119 and 126, orientation films; 120, a liquid crystal; 121, an insulating substrate of an counter substrate; 122, a black matrix (BM); 123, a color filter; 124, a planarization film; and 125, a counter electrode.

In the manufacturing of this active matrix liquid crystal display device, reduction of manufacturing costs and improvement of yield have been advanced by reducing the number of steps therefor.

Here, in order to reduce the number of masks to be used, the pixel electrode 118 to be connected to the drain wiring 116 is directly brought into contact with the drain wiring 116 to achieve conduction.

The source signal line 210 is patterned in the same layer in which the drain wiring 116 and the pixel electrode 118 are patterned. Consequently, a sufficient space part has to be secured between the source signal line 210 and the pixel electrode 118 in order to prevent short-circuit of the source signal line 210 and the pixel electrode 118. In addition, it is necessary to cover this space part with a BM in order to prevent leakage of light from this space part.

FIG. 6B shows a top view of the pixel in this case. For ease of understanding, a part of an area from which the pixel electrode 118 and the BM are removed is shown. Here, FIG. 6A corresponds to a sectional view along line A-A' in FIG. 6B. Note that, in FIG. 6B, the same reference numerals as those of FIG. 6A denote the same portions. Reference numeral 210 denotes a source signal line; 116, drain wiring; 215, a gate signal line; 118, a pixel electrode; and 220, a semiconductor layer, which is equivalent to reference numerals 105 to 107 in FIG. 6A.

Here, a space part 230 is provided between the source signal line 210 and the pixel electrode 118 to prevent the source signal line 210 and the pixel electrode 118 from short-circuiting. Consequently, the area of the pixel electrode 118 cannot be enlarged. Therefore, an opening ratio cannot be increased. In addition, this space part 230 is covered by a BM 122 provided on an counter substrate in order to prevent leakage of light from this space part 230. Here, it is necessary to arrange the BM 122 to overlap the end of the pixel electrode 118 taking into account deviation at the time when a TFT substrate and the counter substrate are adhered to each other, invasion of light, and the like. There is a problem in that the opening ratio further decreases due to this arrangement.

Consequently, a display device having a structure as shown in FIG. 7A has been proposed. Note that, in FIG. 7A, the same reference numerals as those in FIGS. 6A and 6B denote the same portions.

In FIG. 7A, reference numeral 111 denotes a gate electrode; 114, source wiring; 110, a source signal line; and 115, a gate signal line.

In the display device of the sectional view shown in FIG. 7A, the source signal line 110 is formed simultaneously with the gate electrode 111, and the gate signal line 115 is formed simultaneously with the source wiring 114 and the drain wiring 116. Here, the source signal line 110 is connected to the source region of the pixel TFT 102 by this source wiring 114. With this structure, layers in which a source signal line and a gate signal line are formed can be interchanged without increasing the number of masks. Such an arrangement of the source signal line and the gate signal line is called an inverse-cross structure. With this structure, since the source signal line 110 is arranged in a layer below the drain wiring 116, the pixel electrode 118 can be formed above the source signal line 110 and the opening ratio can be increased.

FIG. 7B shows a top view of FIG. 7A. For ease of understanding, a part of an area from which the pixel electrode 118 and the BM are removed is shown. Here, FIG. 7A corresponds to a sectional view along lines A-A' and B-B' in FIG. 7B. The pixel electrode 118 is formed to cover up to the source signal line 110 to prevent leakage of light. Thus, the part of the BM 122 provided on the counter substrate is reduced compared with that in FIG. 6B. In this way, the opening ratio is increased compared with that in FIG. 6.

In the display device using the inverse-cross structure, the gate signal line is formed on the same insulating surface on which the pixel electrode is formed, and an orientation film and a liquid crystal are formed above the insulating surface.

In FIG. 5, it is assumed that a signal voltage for selecting a gate signal line is Vo and a signal voltage for not selecting a gate signal line is set to −Vo. When the number of gate signal lines is assumed to be y, a period in which the gate signal lines are selected (a gate signal line selecting period) is approximately 1/y of one frame period. Thus, the larger y the shorter the gate signal line selecting period becomes, and a ratio of periods in which a signal voltage for not selecting a signal line is applied (a gate signal line non-selecting period) increases. Therefore, the voltage of −Vo continues to be inputted while a pixel is not selected.

In the case in which a standard of a display device is VGA, −Vo is inputted in periods equal to or more than 479/480. A duty at this point is 0.2% or less.

Note that as shown in FIG. 5, since a polarity of a voltage applied to the source signal line is inverted periodically, the voltage does not affect a liquid crystal portion significantly. On the other hand, a voltage inputted in the gate signal line tends to have a fixed polarity as described above. Such a signal voltage inputted in the gate signal line affects a liquid crystal portion arranged immediately above the gate signal line. This becomes a cause for facilitating deterioration of the liquid crystal. In such a case, it is necessary to use a fluorine-based liquid crystal (e.g., T1213, T1216, etc. of Merck & Co., Inc.) with less deterioration, and an inexpensive cyanic liquid crystal cannot be used.

SUMMARY OF THE INVENTION

The present invention has been devised in view of the above and other drawbacks, and it is an object of the invention to manufacture a display device in which influence of a signal voltage applied to a gate signal line, which is exerted on a liquid crystal around the gate signal line, is suppressed.

The invention is characterized in that a liquid crystal is operated during a period in which a backlight is turned off, a period in which whole black display is performed, and a period in which whole white display is performed, and a liquid crystal on a gate signal line is driven with a duty different from that of a display period. In addition, the invention is characterized in that a time width of a start pulse to be inputted in a gate signal line driving circuit is increased in order to increase a duty of alternative current drive of a liquid crystal on a gate signal line.

A constitution of the invention will be hereinafter described.

According to the invention, a liquid crystal display device comprises plural source signal lines, plural gate signal lines, and plural pixels on an insulating substrate, the plural pixels comprise a pixel TFT, a pixel electrode, a counter electrode, a liquid crystal portion arranged between the pixel electrode and the counter electrode, and the liquid crystal portion comprises a first orientation film, a second orientation film, and a liquid crystal sandwiched by the first orientation film and the second orientation film. A gate electrode of the pixel TFT is connected to one of the plural gate signal lines. One of a drain region and a source region of the pixel TFT is connected to one of the plural source signal lines, and the other is connected to the pixel electrode. The first orientation film is arranged between the pixel electrode and the liquid crystal, and the second orientation film is arranged between the counter electrode and the liquid crystal. The pixel electrode and the gate signal lines are formed on the same insulating surface. An inverse of a voltage, which is mainly applied to the gate signal lines during a display period, is applied to the gate signal lines during a backlight off period, a period in which whole black display is performed, or a period in which whole white display is performed.

According to the invention, a liquid crystal display device comprises plural source signal lines, plural gate signal lines, and plural pixels on an insulating substrate, the plural pixels comprise a pixel TFT, a pixel electrode, a counter electrode, source wiring, drain wiring, and a liquid crystal portion arranged between the pixel electrode and the counter electrode, and the liquid crystal portion comprises a first orientation film, a second orientation film, and a liquid crystal sandwiched by the first orientation film and the second orientation film. A gate electrode of the pixel TFT is connected to one of the plural gate signal lines. One of a drain region and a source region of the pixel TFT is connected to one of the plural source signal lines by the source wiring, and the other is connected to the pixel electrode by the drain wiring. The first orientation film is arranged between the pixel electrode and the liquid crystal, and the second orientation film is arranged between the counter electrode and the liquid crystal. The pixel electrode, the gate signal lines, the source wiring, and the drain wiring are formed on the same insulating surface, and the source signal lines is arranged in a layer below the drain wiring. An inverse of a voltage, which is mainly applied to the gate signal lines during a display period, is applied to the gate signal lines during a backlight off period, a period in which whole black display is performed, or a period in which whole white display is performed.

According to the invention, a liquid crystal display device comprises plural source signal lines, plural gate signal lines, and plural pixels on an insulating substrate, the plural pixels comprise a pixel TFT, a pixel electrode, a counter electrode, source wiring, drain wiring, and a liquid crystal portion arranged between the pixel electrode and the counter electrode, and the liquid crystal portion comprises a first orientation film, a second orientation film, and a liquid crystal sandwiched by the first orientation film and the second orientation film. A gate electrode of the pixel TFT is connected to one of the plural gate signal lines. One of a drain region and a source region of the pixel TFT is connected to one of the plural source signal lines by the source wiring, and the other is connected to the pixel electrode by the drain wiring. The first orientation film is arranged between the pixel electrode and the liquid crystal, and the second orientation film is arranged between the counter electrode and the liquid crystal. The pixel electrode, the gate signal lines, the source wiring, and the drain wiring are formed on the same insulating surface, and the source signal lines is arranged in a layer below the drain wiring. Two gate signal lines adjacent to each other of the plural gate signal lines are selected simultaneously during at least two or more line periods.

According to the invention, a liquid crystal display device comprises plural source signal lines, plural gate signal lines, and plural pixels on an insulating substrate, the plural pixels comprise a pixel TFT, a pixel electrode, a counter electrode, and a liquid crystal portion arranged between the pixel electrode and the counter electrode, and the liquid crystal portion comprise a first orientation film, a second orientation film, and a liquid crystal sandwiched by the first orientation film and the second orientation film. A gate electrode of the pixel TFT is connected to one of the plural gate signal lines, one of a drain region and a source region of the pixel TFT is connected to one of the plural source signal lines, and the other is connected to the pixel electrode. The first orientation film is arranged between the pixel electrode and the liquid crystal, and the second orientation film is arranged between the counter electrode and the liquid crystal. The pixel electrode and the gate signal lines are formed on the same insulating surface. Two gate signal lines adjacent to each other of the plural gate signal lines are selected simultaneously during at least two or more line periods. An inverse of a voltage, which is mainly applied to the gate signal lines during a display period, is applied to the gate signal lines during a backlight off period, a period in which whole black display is performed, or a period in which whole white display is performed.

According to the invention, a liquid crystal display device comprises plural source signal lines, plural gate signal lines, and plural pixels on an insulating substrate, the plural pixels comprise a pixel TFT, a pixel electrode, a counter electrode, source wiring, drain wiring, and a liquid crystal portion arranged between the pixel electrode and the counter electrode, and the liquid crystal portion comprises a first orientation film, a second orientation film, and a liquid crystal sandwiched by the first orientation film and the second orientation film. A gate electrode of the pixel TFT is connected to one of the plural gate signal lines, one of a drain region and a source region of the pixel TFT is connected to one of the plural source signal lines by the source wiring, and the other is connected to the pixel electrode by the drain wiring. The first orientation film is arranged between the pixel electrode and the liquid crystal, and the second orientation film is arranged between the counter electrode and the liquid crystal. The pixel electrode, the gate signal lines, the source wiring, and the drain wiring are formed on the same insulating surface, and the source signal lines is arranged in a layer below the drain wiring. Two gate signal lines adjacent to each other of the plural gate signal lines are selected simultaneously during at least two or more line periods. An inverse of a voltage, which is mainly applied to the gate signal lines during a display period, is applied to the gate signal lines during a backlight off period, a period in which whole black display is performed, or a period in which whole white display is performed.

According to the invention, a liquid crystal display device comprises plural source signal lines, plural gate signal lines, and plural pixels on an insulating substrate, the plural pixels comprise a pixel TFT, a pixel electrode, a counter electrode, and a liquid crystal portion arranged between the pixel electrode and the counter electrode, the liquid crystal portion comprises a first orientation film, a second orientation film, and a liquid crystal sandwiched by the first orientation film and the second orientation film. A gate electrode of the pixel TFT is connected to one of the plural gate signal lines, one of a drain region and a source region of the pixel TFT is connected to one of the plural source signal lines, and the other being connected to the pixel electrode. The first orientation film is arranged between the pixel electrode and the liquid crystal, and the second orientation film being arranged between the counter electrode and the liquid crystal. The pixel electrode and the gate signal lines are formed on the same insulating surface. Two gate signal lines adjacent to each other of the plural gate signal lines are selected simultaneously during at least two or more line periods.

According to the invention, a liquid crystal display device a clock pulse supplied to a signal line driving circuit is stopped in the backlight off period, the period in which whole black display is performed or the period in which whole white display is performed.

According to the invention, a frequency of a clock pulse supplied to a driving circuit is set lower than that in a period in which display is performed in the backlight off period, the period in which whole black display is performed or the period in which whole white display is performed.

According to the invention, a start pulse supplied to a driving circuit is fixed to Hi or Lo in the backlight off period, the period in which whole black display is performed or the period in which whole white display is performed.

According to the invention, an inverse of a voltage mainly applied to the gate signal lines during a period in which a display is performed is applied with an inverse of a duty in a display period during a backlight off period, a period in which whole black display is performed, or a period in which whole white display is.

According to the invention, two gate signal lines adjoining each other are selected simultaneously during at least two, preferably five to twenty line periods.

According to the invention, a material of the liquid crystal is a cyanic liquid crystal.

According to the invention, an electronic apparatus comprising the liquid crystal display device of the invention is provided.

With above-mentioned constitution, deterioration of a liquid crystal material on a gate signal line can be reduced, and not only a fluorine-base liquid crystal but also a cyanic liquid crystal can be used.

DESCRIPTION OF THE PREFERRED EMBODIMENTS

An embodiment mode of the present invention will be hereinafter described in detail with reference to the accompanying drawings.

As described above, in a liquid crystal display device using the inverse-cross structure, a duty of an applied voltage of a liquid crystal material on a gate signal line takes a value as low as 0.2% at the time of display. The inventor takes measures against this problem taking notice of two points described below.

In the first place, a first measure will be described. The first measure is a measure to be taken at the time of non-display. That is, in the conventional liquid crystal display device, some voltage is applied to a liquid crystal material at the time of display, but no voltage is applied to the liquid crystal material at the time of non-display (at the time when a user does not expect an image such as at the time of backlight off, whole black display, or whole white display). Thus, when a voltage shifted to one side is applied to the liquid crystal material at the time of display, that state is continuously held at the time of non-display. The voltage shifted to one side is applied again at the time of display, and the liquid crystal material is further deteriorated.

Figures 1A, 1B:
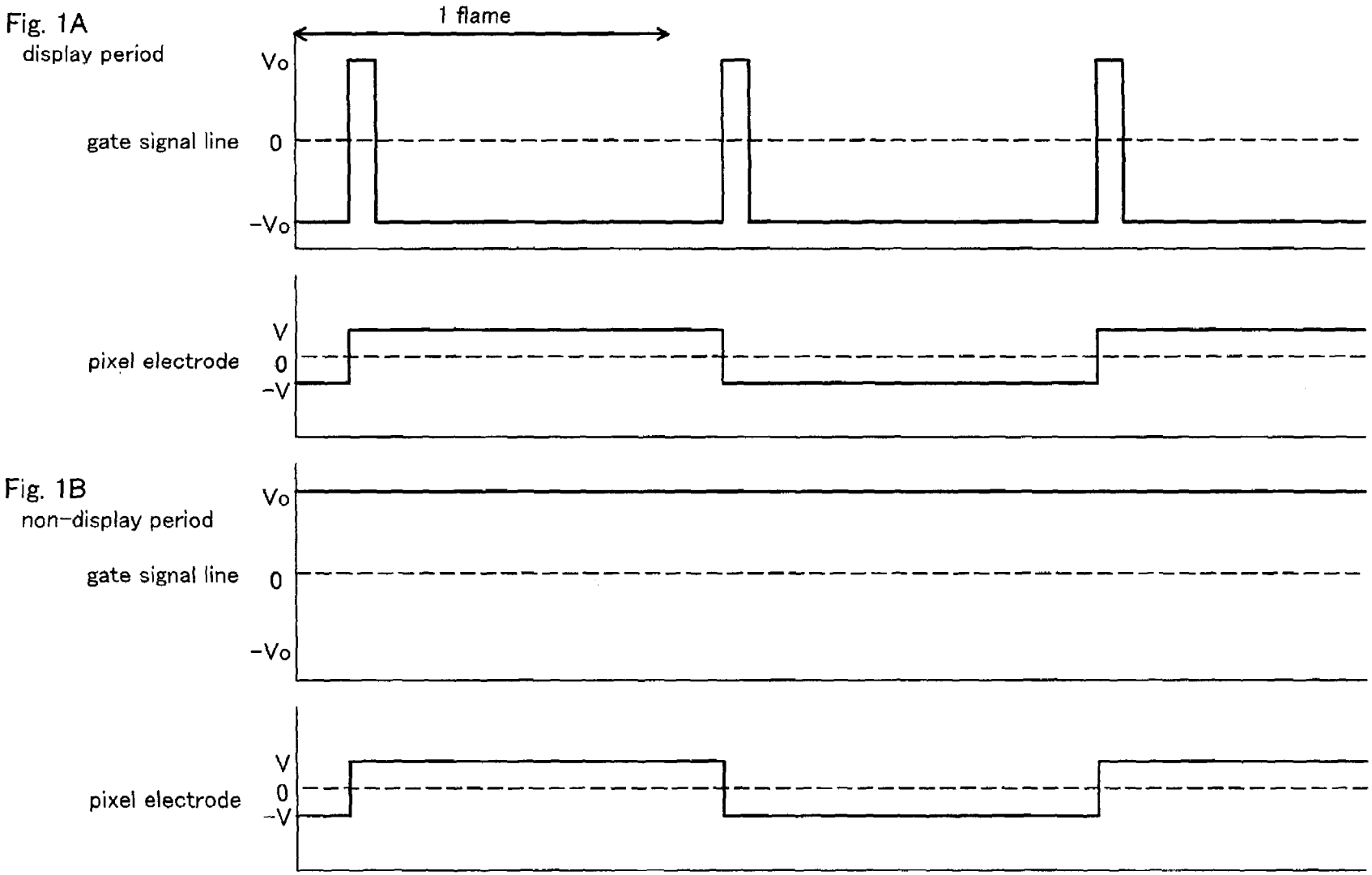
FIGS. 1A and 1B are timing charts of a liquid crystal device of the present invention.
Figures 16A, 16B:
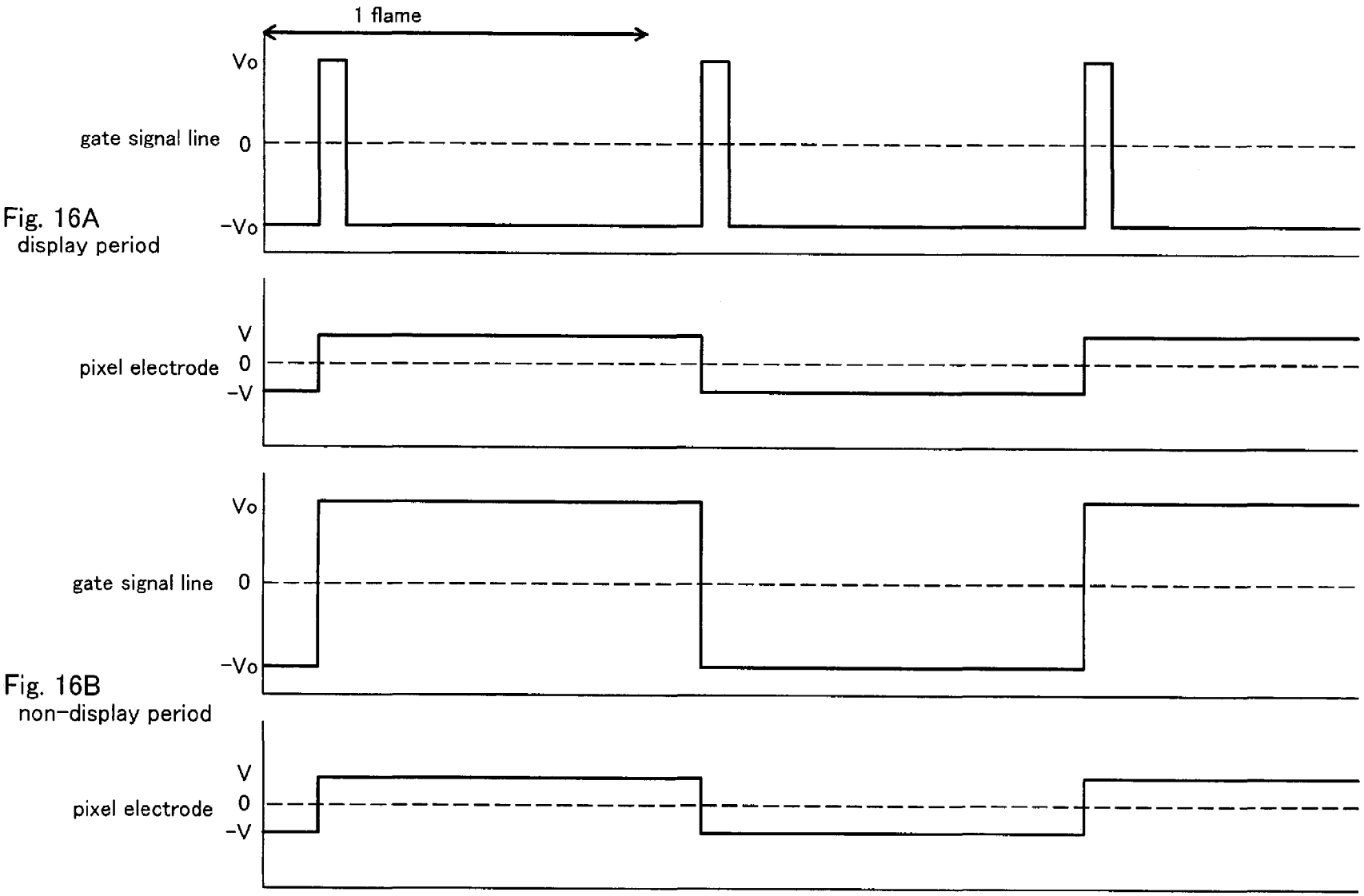
FIGS. 16A and 16B are timing charts of the liquid crystal display device of the invention.

Thus, the inventor devised a method of driving a liquid crystal such that an inverse of a voltage, which is mainly applied to a gate signal line at the time of display, is applied. FIG. 1A is a timing chart showing voltages applied to a gate signal line and a pixel electrode at the time of display. The voltages are the same as those in the conventional liquid crystal display device. Next, FIG. 1B is a timing chart showing voltages to the gate signal line and the pixel electrode at the time of non-display in the present invention. Although the voltage applied to the pixel electrode is the same as that in the conventional liquid crystal image display device, a voltage of +Vo is applied to the gate electrode. In this way, an inverse of a voltage, which is mainly applied to a gate signal line at the time of display, is applied at the time of non-display, whereby deterioration of the liquid crystal material is prevented. Note that a voltage applied to the gate signal line may be a voltage with +Vo and −Vo interchanging periodically as shown in FIG. 16 or may be a voltage having, at the time of non-display, a duty of 99.8%, which is entirely an inverse of a duty at the time of display.

In addition, driving the liquid crystal display device as it is at the time of non-display causes a significant loss in terms of electric power even if the backlight is turned off. Since a power supply is cut off at the time of non-display in the conventional liquid crystal display device, electric power consumption is almost zero. In the invention, a measure described below is used to cope with this problem.

Figure 2:
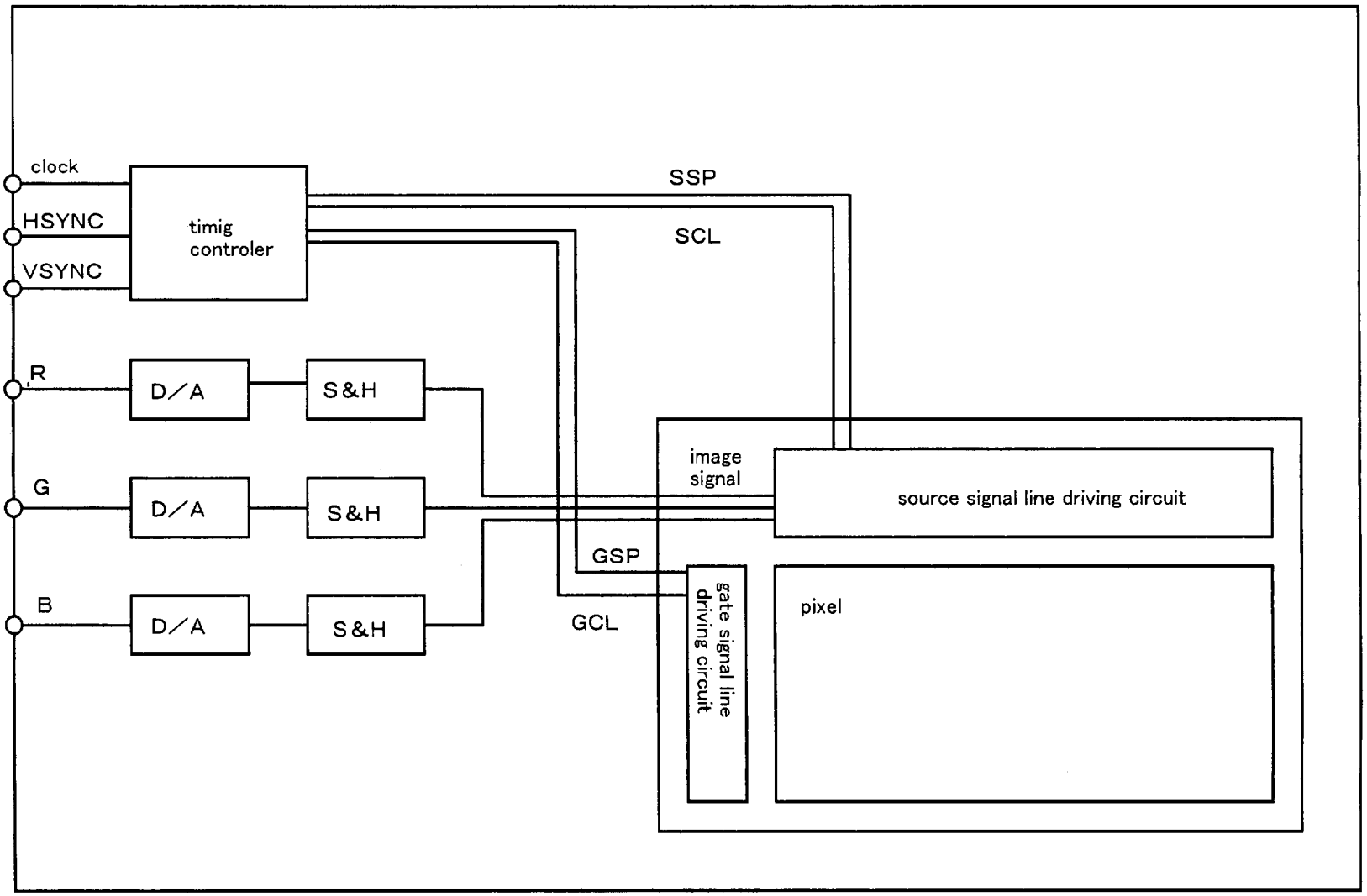
FIG. 2 is a block diagram of the liquid crystal display device of the invention.
Figure 3:
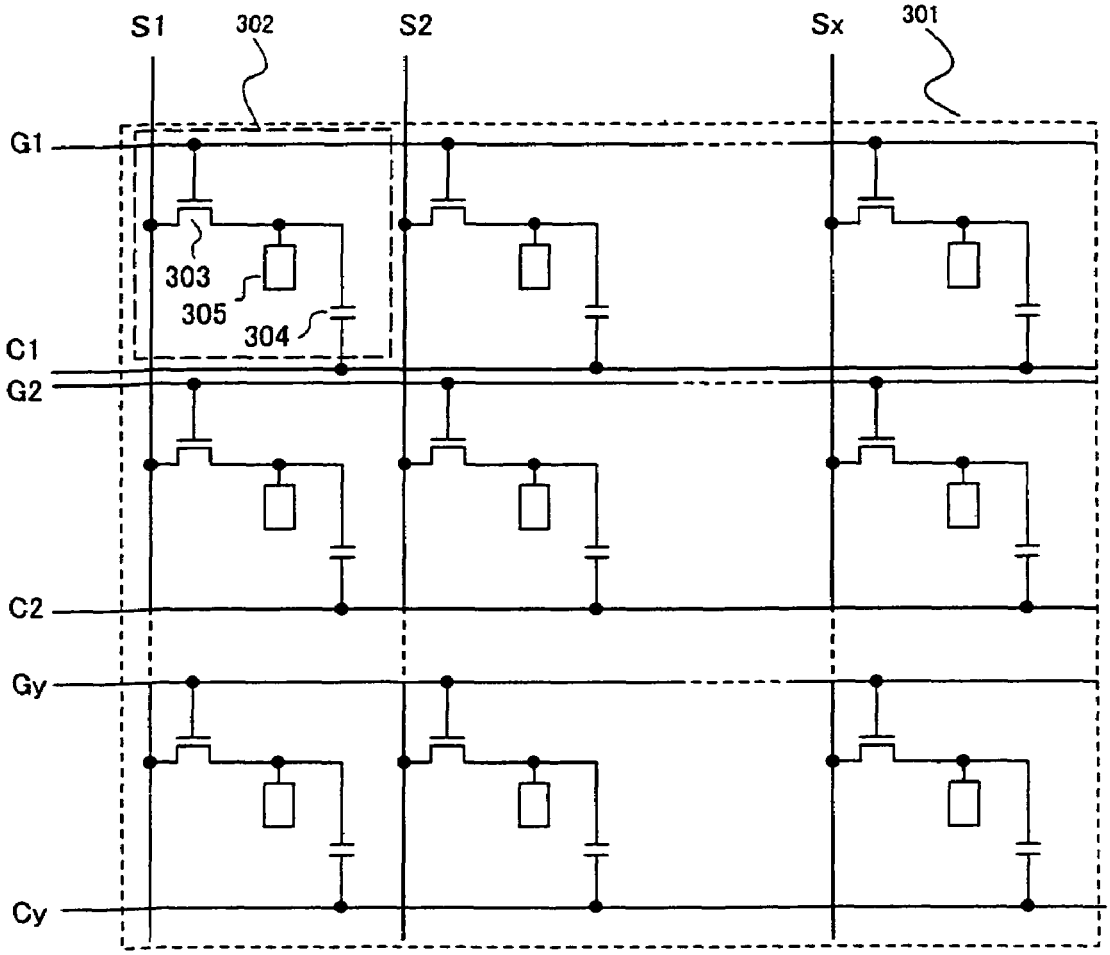
Fig. 3 PRIOR ART
FIG. 3 is a diagram showing a structure of a pixel portion of the liquid crystal display device.
Figure 4:
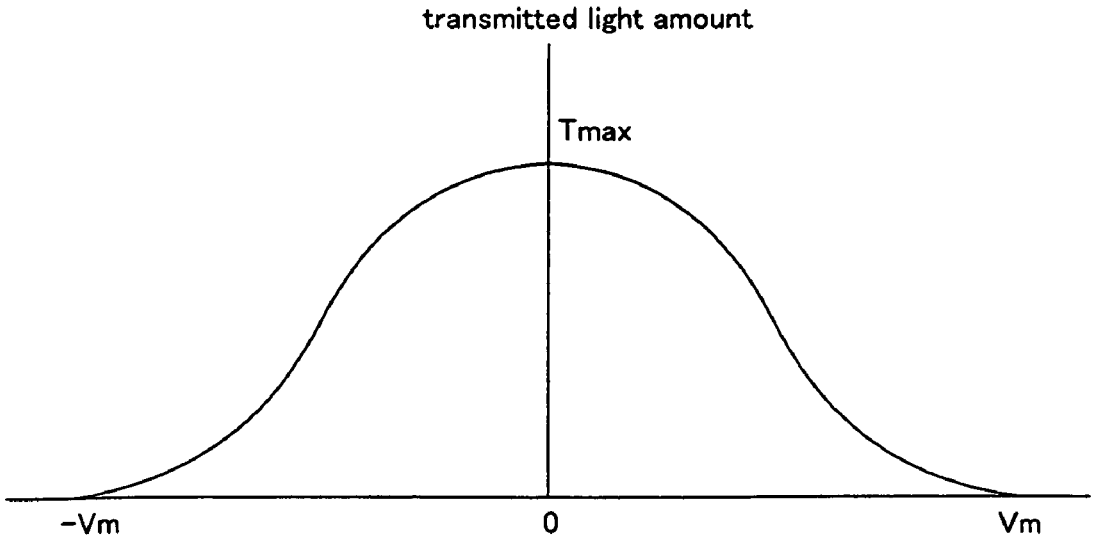
Fig. 4 PRIOR ART
FIG. 4 is a graph showing a relationship between an applied voltage and a transmitted light amount of a liquid crystal.
Figure 5:
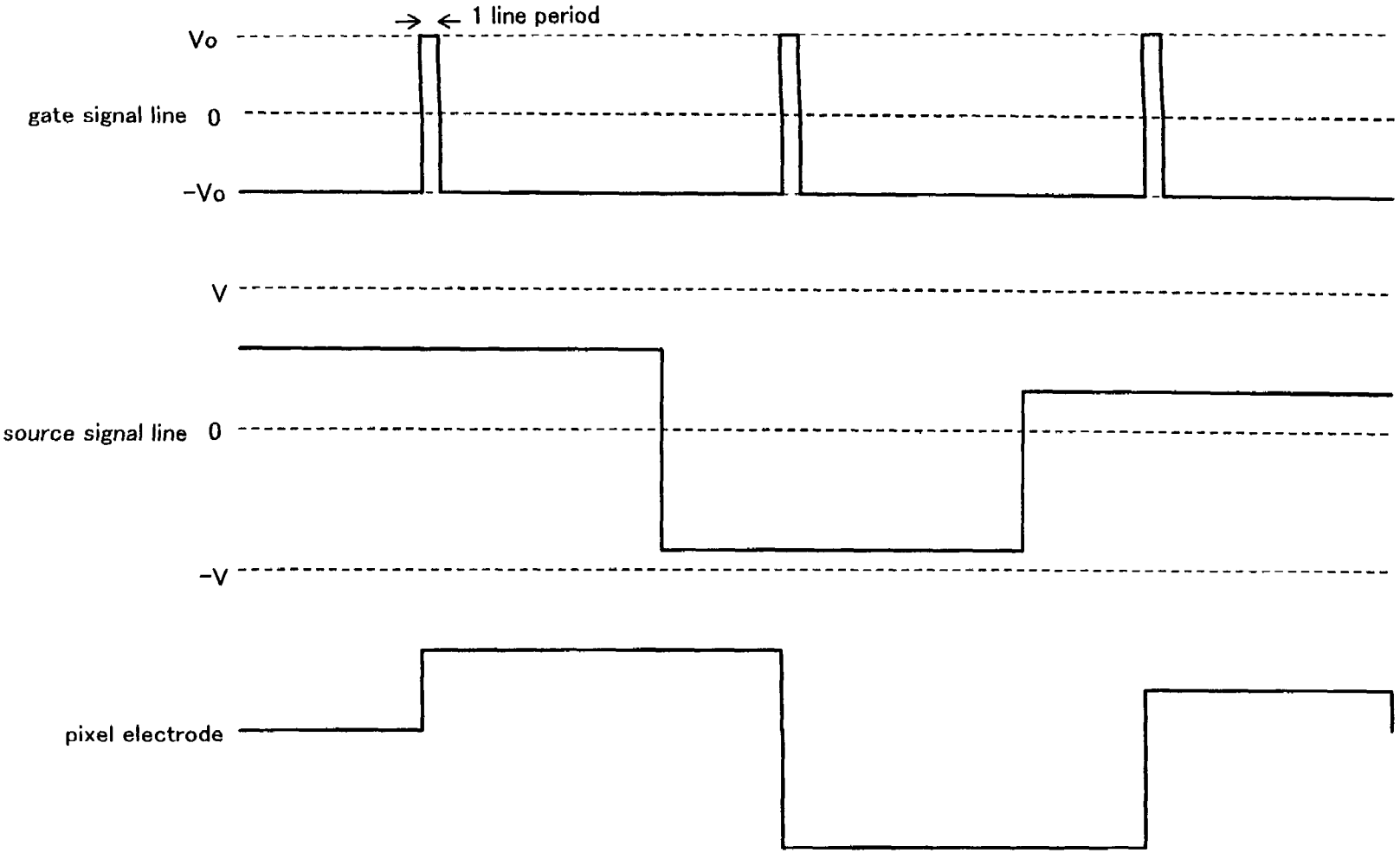
Fig. 5 PRIOR ART
FIG. 5 is a timing chart of a conventional liquid crystal display device.
Figure 6A:
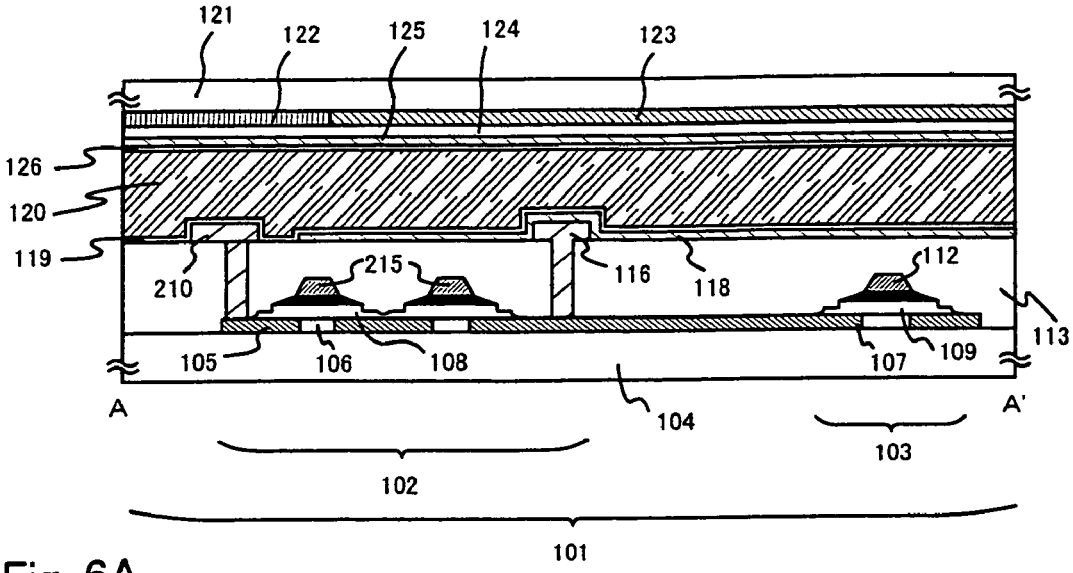
Fig. 6A PRIOR ART
FIGS. 6A and 6B are a sectional view and a top view of a pixel portion of the conventional liquid crystal display device, respectively.
Figure 6B:
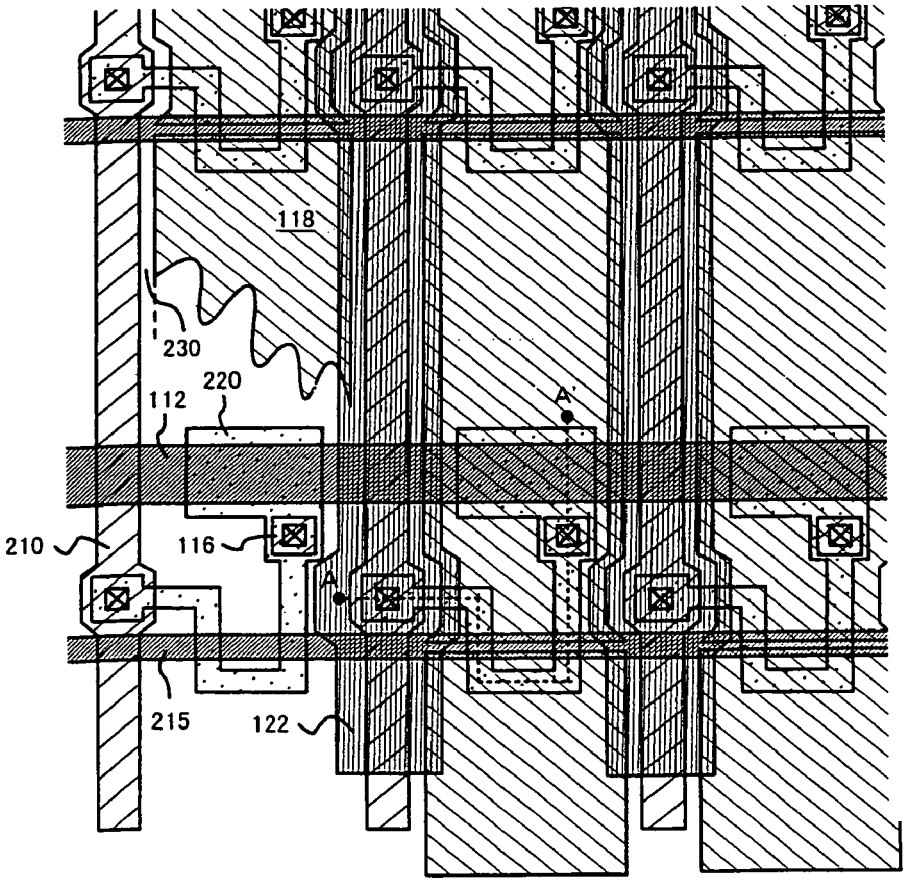
Fig. 6B PRIOR ART
Figure 7A:
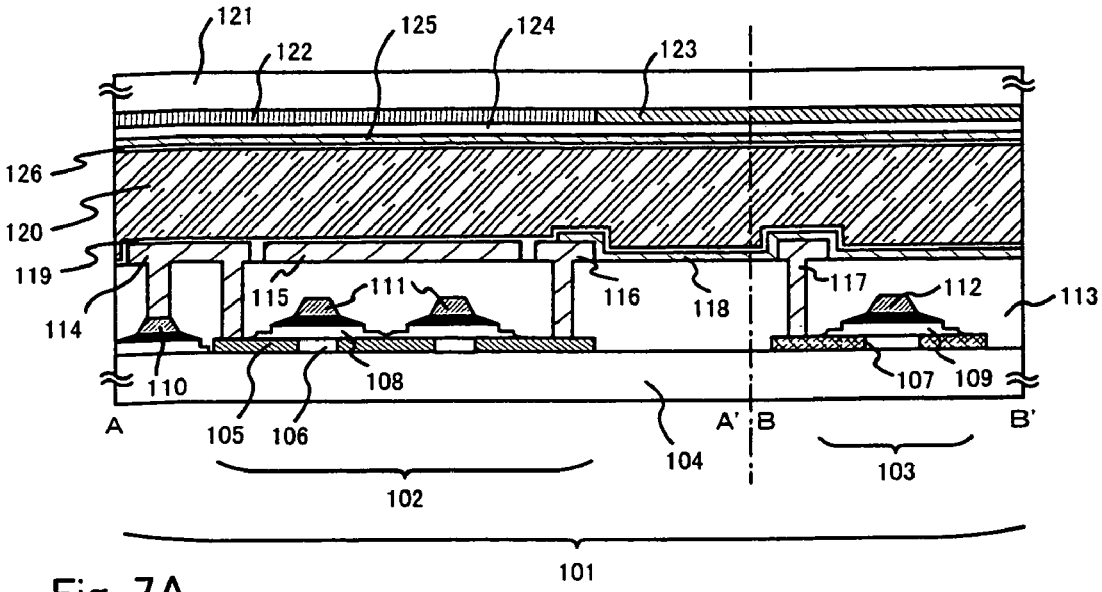
Fig. 7A PRIOR ART
FIGS. 7A and 7B are a sectional view and a top view of a pixel portion of the conventional liquid crystal display device, respectively.
Figure 7B:
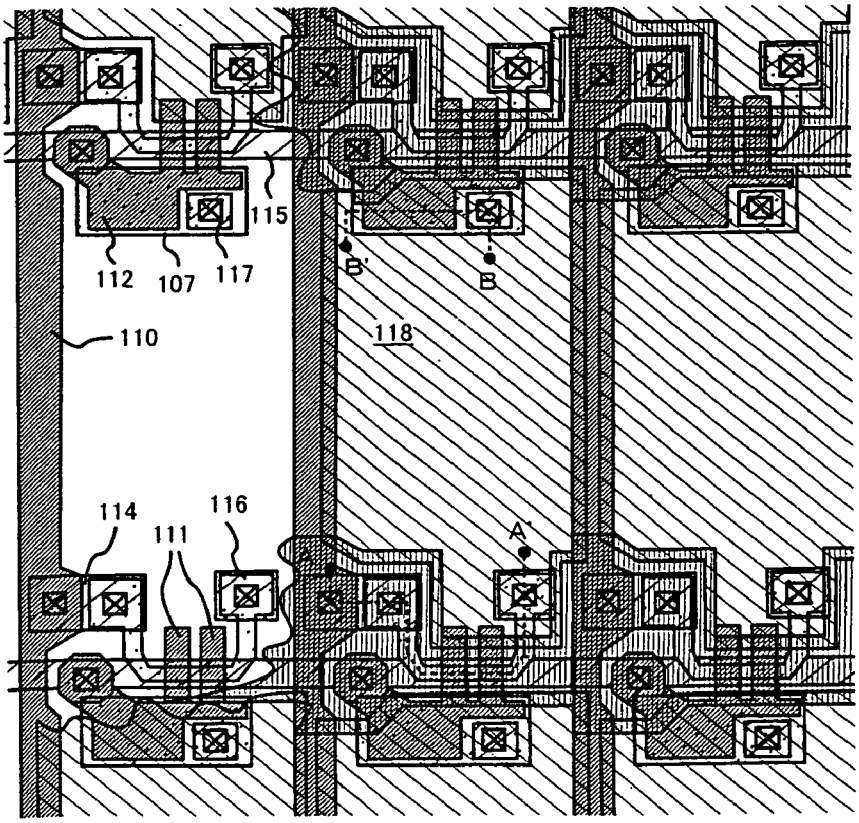
Fig. 7B PRIOR ART

FIG. 2 is a block diagram of the liquid crystal display device of the invention. In this example, a liquid crystal display device using an analog drive circuit is shown. A clock, a vertical synchronizing signal (VSYNC), a horizontal synchronizing signal (HSYNC), and digital video signals of R, G, and B are inputted from the outside. A source start pulse (SSP), a source clock (SCL), a gate start pulse (GSP), and a gate clock (GCL) for driving a source signal line driving circuit and a gate signal line driving circuit are generated from the clock, the VSYNC, and the HSYNC in a timing controller. In addition, the digital video signals are converted into analog signals in a D/A converter, subjected to time axis extension in an S & H circuit, and inputted in the source signal line driving circuit.

Figure 17:
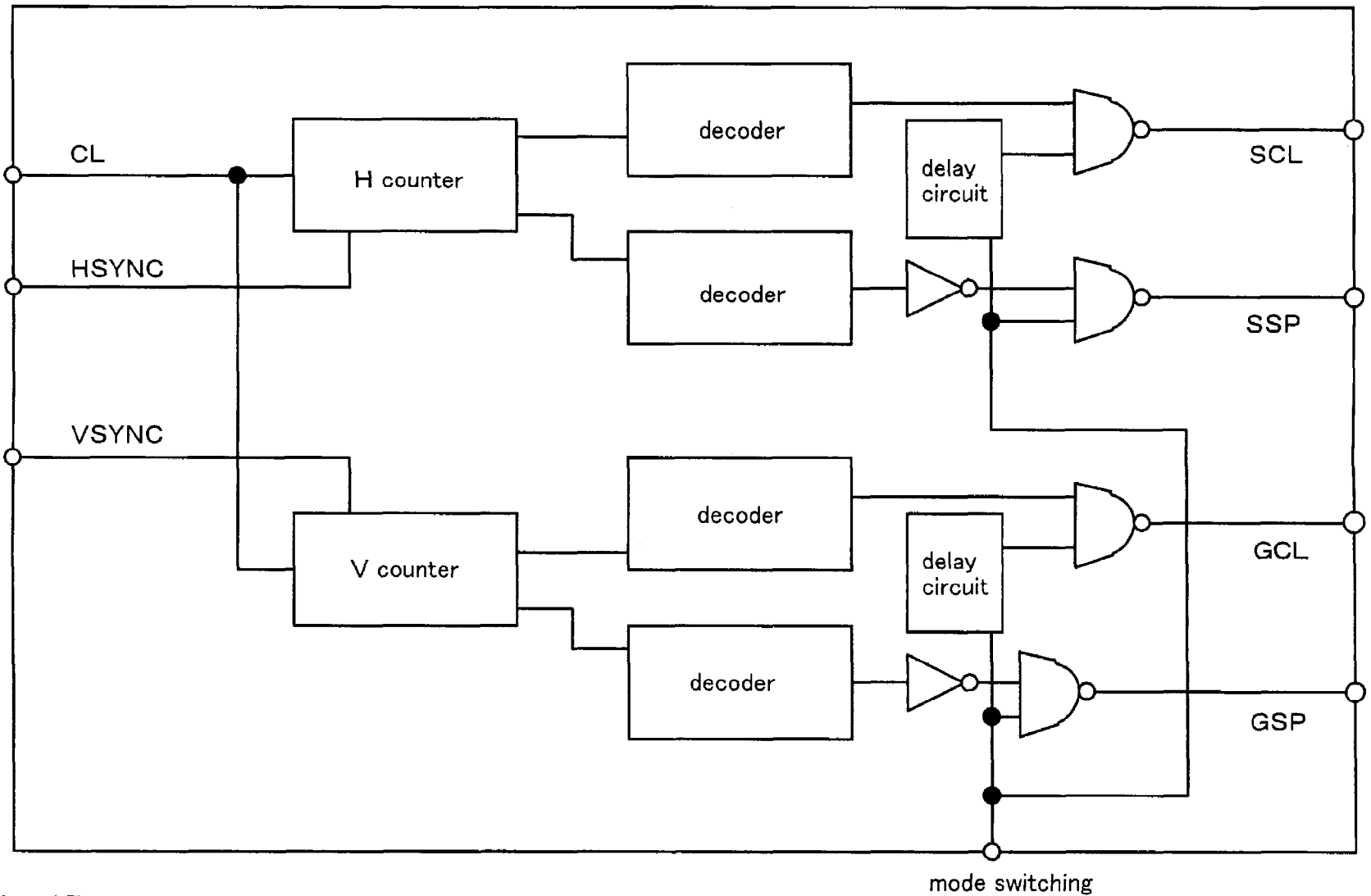
FIG. 17 is a block diagram of a timing controller used in the liquid crystal display device of the invention.

FIG. 17 shows a block diagram of the timing controller. In the timing controller, clocks inputted from the outside are counted by a counter, and an output of the counter is inputted in a decoder to generate an SSP, an SCL, a GSP, and a GCL. This part is the same in a timing controller used for the conventional liquid crystal display device. In the invention, a circuit including an NAND and a delay circuit is added in addition to the above. When a mode switching terminal is Hi, the SSP, the SCL, the GSP, and the GCL are generated in the same manner as in the conventional timing controller.

However, when the mode switching terminal is changed to Lo, the start pulses (GSP and SSP) are fixed to Hi. Consequently, shift register outputs of the source signal line driving circuit and the gate signal line driving circuit are fixed to Hi. As a result, a potential of the gate signal line can be set to +Vo.

In addition, when a signal reaches the NAND circuit through the delay circuit, the clocks (SCL and GCL) are fixed to Lo. Consequently, input/output of the shift register is fixed and consumption of electric power is eliminated. Here, the delay circuit is used for stopping the clocks until the shift register performs all stage scanning after a mode switching signal is inputted. In this way, increase in electric power consumption can be controlled even if a voltage is applied to the liquid crystal at the time of non-display. In addition, electric power can be reduced by reducing a clock frequency even if the clocks are not completely stopped.

Figure 8:
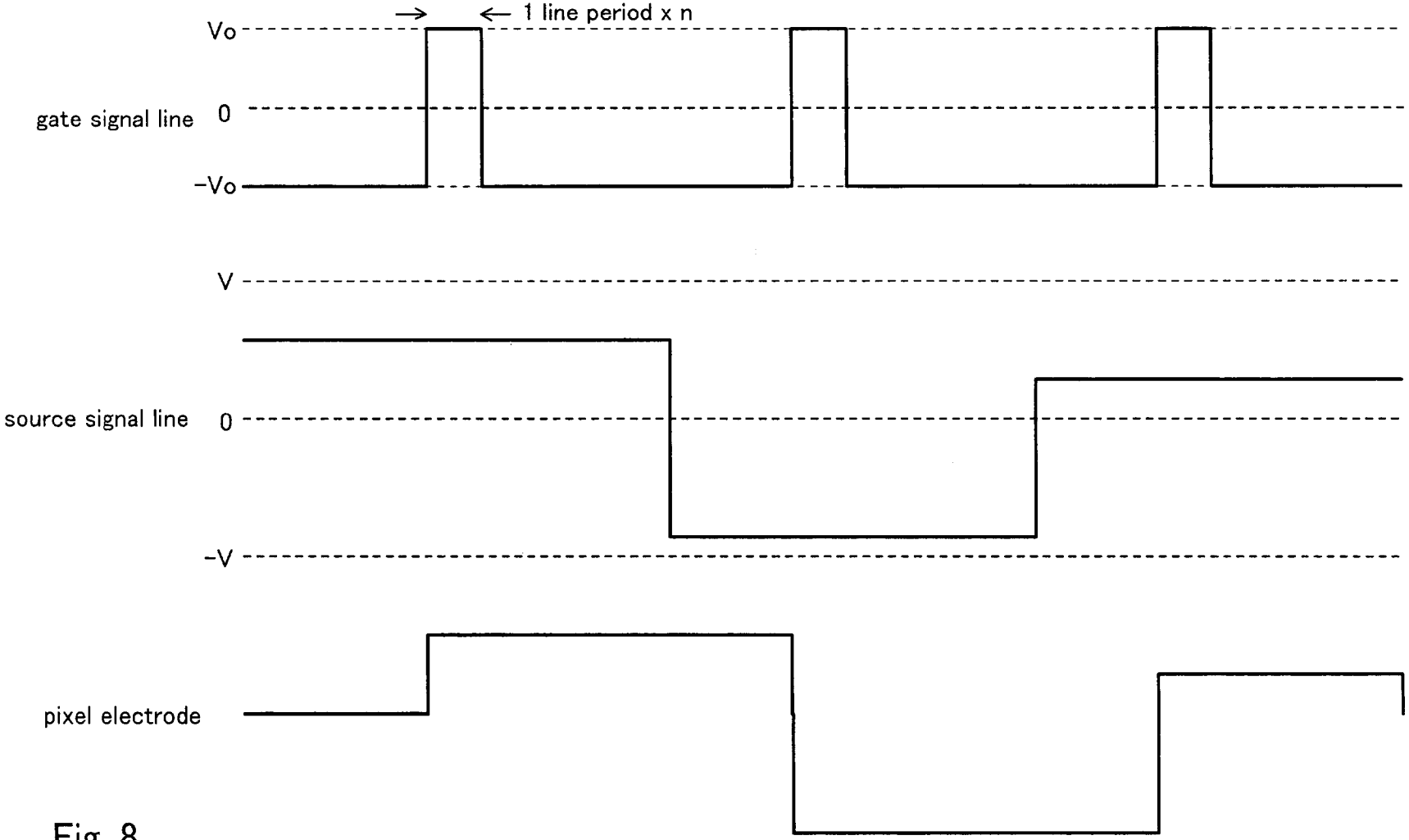
FIG. 8 is a timing chart of the liquid crystal display device of the invention.

Next, a second measure will be described. The second measure is a measure for increasing a duty applied to a liquid crystal material on a gate signal line even at the time of display. FIG. 8 shows voltages applied to the gate signal line. The liquid crystal display device of the invention is different from the conventional liquid crystal display device in that a period in which a voltage of the gate signal line is +Vo is long. Here, the period is set to n line periods, which is n times as long as the period of the conventional liquid crystal display device. In the case of VGA, n takes a value from 2 to several tens, and more preferably a value from 5 to 20. In the case in which the number of vertical lines of a screen increases or decreases, it is better to increase or decrease this value in proportion to the number of vertical lines of the screen.

This measure can be realized by extending a time width of a start pulse of the gate signal line driving circuit. When a gate signal line remains Hi for two line periods or more in this way, as a picture corresponding to the gate signal line, data before the gate signal line becomes Lo is held in a pixel. Data prior to the data is held once. However, since it is updated immediately and a liquid crystal has a low response speed and does not respond in a time in the order of one line period, the data does not appear on display.

As described above, deterioration of a liquid crystal material on a gate signal line can be reduced by using the first or the second measure. In addition, according to the invention, not only a fluorine-based material but also a cyanic material can be used as the liquid crystal material.

Embodiment 1

Figure 9:
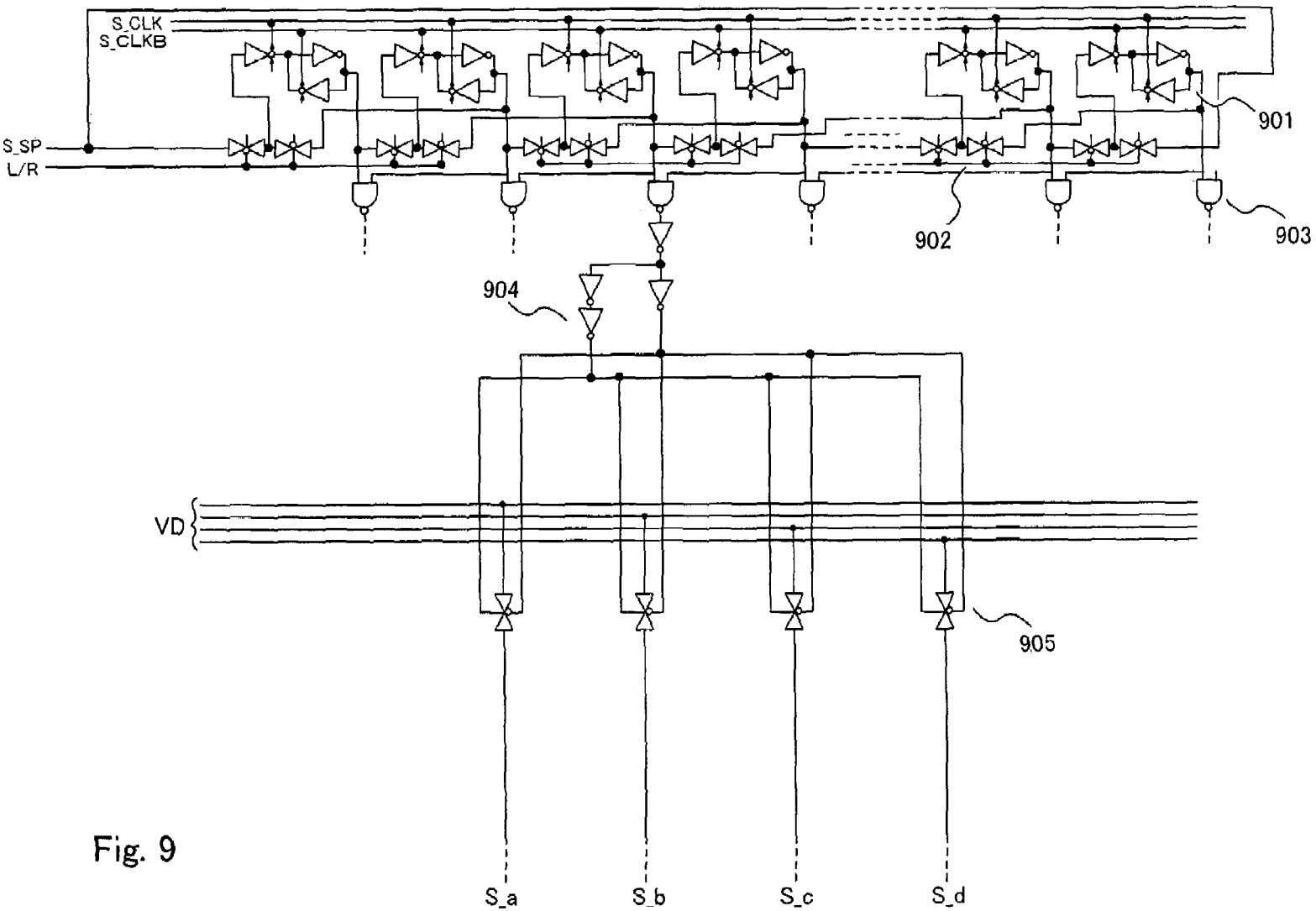
FIG. 9 is a diagram showing a source signal line driving circuit of the invention.

In this embodiment, an example of a structure of a source signal line driving circuit of the display device of the present invention will be described. FIG. 9 shows an example of a structure of the source signal line driving circuit. Here, an analog source signal line driving circuit will be described. However, not only the analog source signal line driving circuit but also a digital source signal line driving circuit may be used.

The source signal line driving circuit is constituted by shift registers 901, scanning direction switching circuits 902, NAND circuits 903, buffer circuits 904, and analog switches 905. Note that, in FIG. 9, only a buffer circuit and an analog switch AT associated with one of outputs from the shift register 901 are illustrated. However, the buffer circuits 904 and the analog switches 905 are associated with all outputs from the shift registers 901.

The shift registers 901 include clocked inverters and inverters. A start pulse for source signal line driving circuit S_SP is inputted in the shift registers 901. The clocked inverters change their state from a conduction state to a non-conduction state according to a clock pulse for source signal line driving circuit S_CLK and a clock pulse for source signal line driving circuit S_CLKB which is a signal with a polarity inverted from that of S_CLK, whereby the shift registers 901 output sampling pulses to the buffer circuits 904 in order from the NAND circuits 903.

In addition, the scanning direction switching circuit 902 functions to switch an operation direction of the shift registers 901 to the left and right on the figure. In FIG. 9, in the case in which a left and right switching signal L/R corresponds to a signal of Lo, the shift registers 901 output sampling pulses in order from the left to the right on the figure. On the other hand, in the case in which the left and right switching signal L/R corresponds to a signal of Hi, the shift registers 901 output sampling pulses in order from the right to the left on the figure.

Here, a digital video signal VD outputted from the signal control circuit described in the embodiment mode is divided into p signals P is a positive integer to be inputted. That is, signals corresponding to outputs to p source signal lines are inputted in parallel. When sampling pulses are inputted in the analog switches 905 of p stages simultaneously via the buffer circuit 904, input signals divided into p are simultaneously sampled, respectively.

Here, since the source signal line driving circuit is described with that for outputting a signal current to x source signal lines as an example, x/p sampling pulses per one horizontal period are outputted in order from the shift register 901 according to each sampling pulse. The analog switches 905 of p stages performs sampling of analog video signals corresponding to outputs to the p source signal lines simultaneously according to each sampling pulse.

In this specification, a method of dividing an analog video signal, which is inputted in the source signal line driving circuit in this way, into parallel signals of p phases and capturing p digital video signals simultaneously according to one sampling pulse is referred to as p division driving. In FIG. 9, an analog video signal is divided into four parallel signals.

By performing the above-mentioned division driving, a margin can be given to sampling of a shift register of a source signal line driving circuit. In this way, reliability of a display device can be improved.

Note that, although not illustrated in this figure, a level shifter, a buffer, or the like may be provided appropriately.

The start pulse S_SP, the clock pulse S_CLK, and the like inputted in the shift register 901 are inputted in the timing controller described in the embodiment mode of the invention.

In the invention, control of a start pulse and a clock pulse at the time of non-display with a timing controller to realize reduction of electric power consumption.

Note that, in the display device of the invention, not only the source signal line driving circuit of the structure of this embodiment but also a source signal line driving circuit of a publicly known structure can be used freely.

Embodiment 2

In this embodiment, an example of a structure of a gate signal line driving circuit in a display device according to the present invention will be described.

The gate signal line driving circuit includes a shift register and a scan direction switching circuit. Note that, although not shown here, a level shifter, a buffer, and the like may be provided as appropriate.

A start pulse G_SP, a clock pulse G_CL, and the like are inputted to the shift register to output a signal for selecting a gate signal line.

Figure 14:
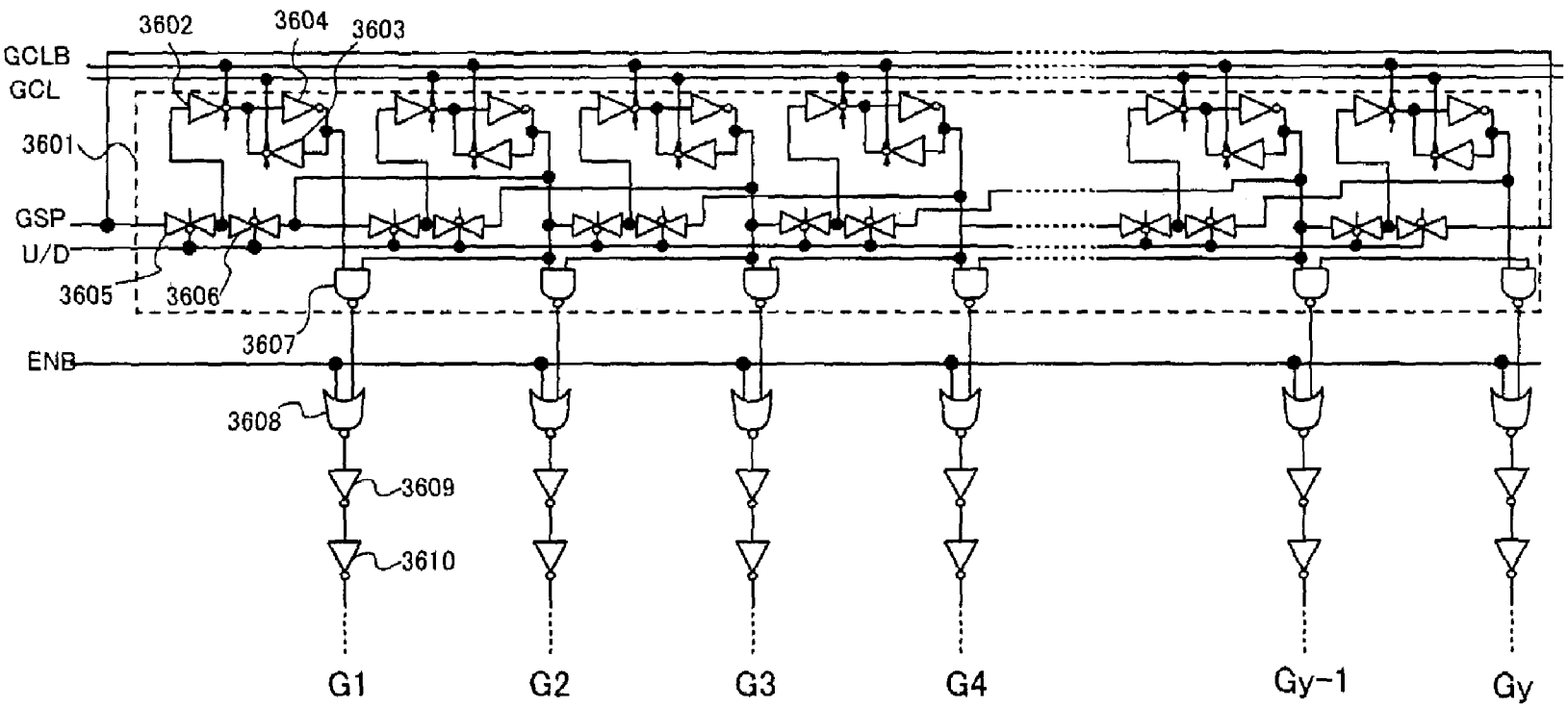
FIG. 14 is a diagram showing a gate signal line driving circuit of the invention.

A structure of the gate signal line driving circuit will be described using FIG. 14.

A shift register 3601 is composed of clocked inverters 3602 and 3603, an inverter 3604, and a NAND circuit 3607. A start pulse G_SP is inputted to the shift register 3601. The clocked inverters 3602 and 3603 are changed between an on state and an off state by a clock pulse G_CL and an inverted clock pulse G_CLB which is a signal having an inverted polarity. Thus, sampling pulses are outputted in order from the NAND 3607.

The scan direction switching circuit is composed of switches 3605 and 3606, which act so as to switch a scan direction of the shift register from side to side in the drawing. In FIG. 14, when a scan direction switching signal U/D corresponds to a signal of Lo, the shift register outputs sampling pulses in order from the left to the right in the drawing. On the other hand, when the scan direction switching signal U/D corresponds to a signal of Hi, the shift register outputs the sampling pulses in order from the right to the left in the drawing.

The sampling pulses outputted from the shift register are inputted to NORs 3608 and are operated as an enable signal ENB. The operation is carried out to prevent a state in which adjacent gate signal lines are simultaneously selected, due to rounding of the sampling pulses. The signals outputted from the NORs 3608 are outputted to gate signal lines G1 to Gy through buffers 3609 and 3610.

Note that, although not shown here, a level shifter, a buffer, and the like may be provided as appropriate.

The start pulse G_SP, the clock pulse G_CL, and the like which are inputted to the shift register are inputted from the timing controller shown in Embodiment Mode.

In the present invention, at nondisplay, the operations for reducing or stopping the clock pulse GCL inputted to the shift register of the gate signal line driving circuit and a frequency of the start pulse GSP or the like are carried out by the timing controller.

Note that the display device of the present invention is not limited to the structure of the gate signal line driving circuit of this embodiment and a gate signal line driving circuit having a known structure can be freely used.

This embodiment can be embodied by being freely combined with Embodiment 1.

Embodiment 3

In Embodiment 3, a method of simultaneously manufacturing TFTs and retention volumes provided in the pixel portion and the driving circuit portion (a source signal line driving circuit and agate signal line driving circuit) provided periphery thereof of the liquid crystal display device is described with reference to FIGS. 10 to 12. However, in order to simplify the explanation, a CMOS circuit, which is the basic circuit for the driving circuit, is shown in the figures.

Figures 10A, 10B, 10C:
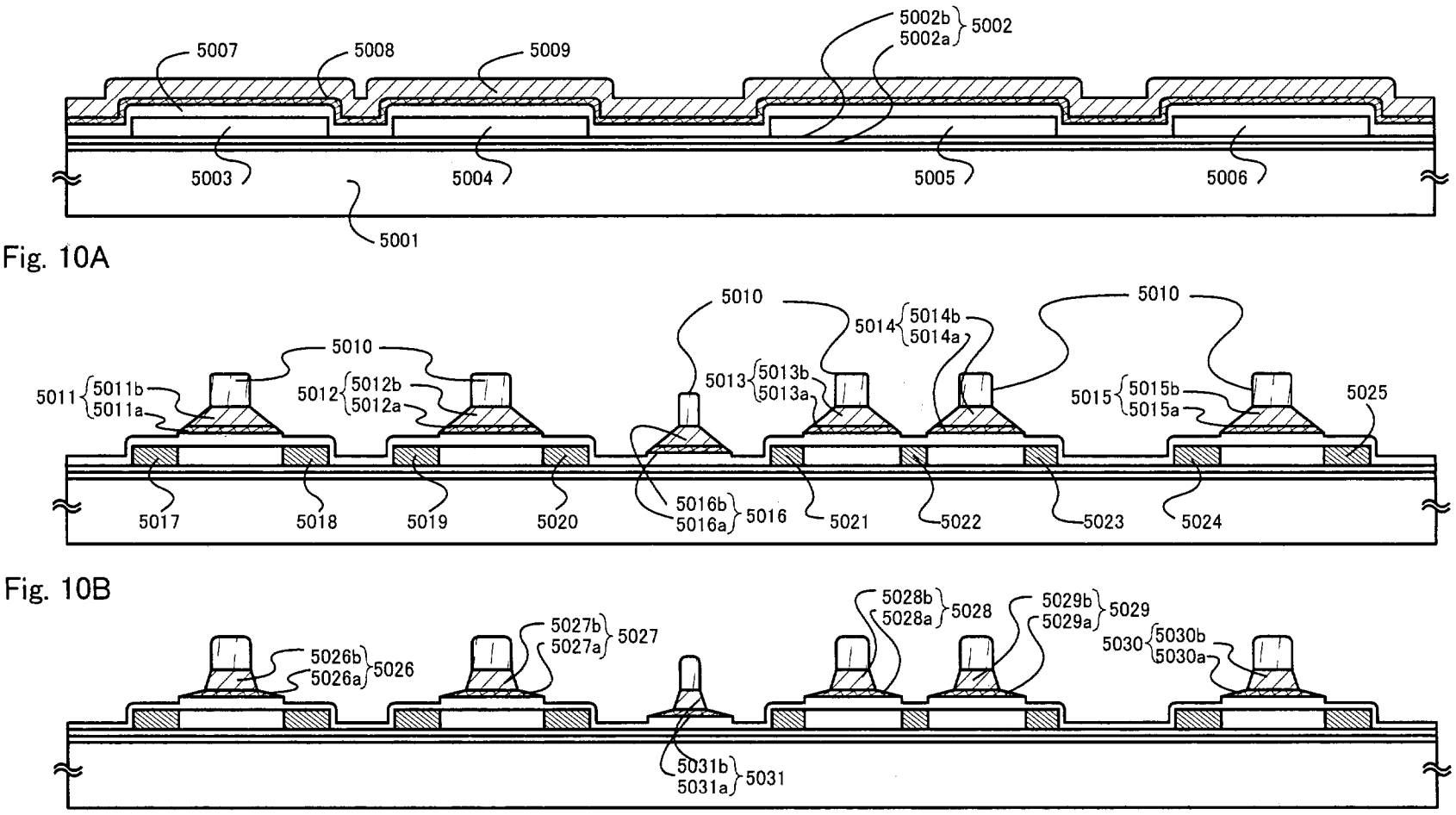
FIGS. 10A to 10C are views showing a manufacturing process of the liquid crystal display device of the invention.

First, as shown in FIG. 10A, a base film 5002 made of an insulating film such as a silicon oxide film, a silicon nitride film, or a silicon oxynitride film is formed on a substrate 5001 made of glass such as barium borosilicate glass or alumino borosilicate glass, typified by #7059 glass or #1737 glass of Corning Inc. For example, a silicon oxynitride film 5002*a* fabricated from $SiH_4$, $NH_3$ and $N_2O$ by a plasma CVD method is formed with a thickness of 10 to 200 nm (preferably 50 to 100 nm), and a hydrogenated silicon oxynitride film 5002*b* similarly fabricated from $SiH_4$ and $N_2O$ is formed with a thickness of 50 to 200 nm (preferably 100 to 150 nm) to form a lamination. In Embodiment 3, although the base film 5002 is shown as the two-layer structure, the film may be formed of a single layer film of the foregoing insulating film or as a lamination structure of more than two layers.

Island-like semiconductor films 5003 to 5006 are formed of a crystalline semiconductor film manufactured by using a laser crystallization method on a semiconductor film having an amorphous structure, or by using a known thermal crystallization method. The thickness of the island-like semiconductor films 5003 to 5006 is set from 25 to 80 nm (preferably between 30 and 60 nm). There is no limitation on the crystalline semiconductor film material, but it is preferable to form the film from silicon or a silicon germanium (SiGe) alloy.

A laser such as a pulse oscillation type or continuous emission type excimer laser, a YAG laser, an $YVO_4$ laser, or CW laser is used for manufacturing the crystalline semiconductor film in the laser crystallization method. A method of condensing laser light emitted from a laser oscillator into a linear shape by an optical system and then irradiating the light to the semiconductor film may be employed when these types of lasers are used. The crystallization conditions may be suitably selected by the operator, but the pulse oscillation frequency is set to 30 Hz, and the laser energy density is set from 100 to 400 mJ/cm$^2$ (typically between 200 and 300 mJ/cm$^2$) when using the excimer laser. Further, the second harmonic is utilized when using the YAG laser, the pulse oscillation frequency is set from 1 to 10 kHz, and the laser energy density may be set from 300 to 600 mJ/cm$^2$ (typically between 350 and 500 mJ/cm$^2$). The laser light which has been condensed into a linear shape with a width of 100 to 1000 μm, for example 400 μm, is then irradiated over the entire surface of the substrate. This is performed with an overlap ratio of 80 to 98% in case of the linear laser.

Next, a gate insulating film 5007 is formed covering the island-like semiconductor layers 5003 to 5006. The gate insulating film 5007 is formed of an insulating film containing silicon with a thickness of 40 to 150 nm by a plasma CVD method or a sputtering method. A 120 nm thick silicon oxynitride film is formed in Embodiment 3. The gate insulating film 5007 is not limited to such a silicon oxynitride film, of course, and other insulating films containing silicon may also be used, in a single layer or in a lamination structure. For example, when using a silicon oxide film, it can be formed by the plasma CVD method with a mixture of TEOS (tetraethyl orthosilicate) and $O_2$, at a reaction pressure of 40 Pa, with the substrate temperature set from 300 to 400° C., and by discharging at a high frequency (13.56MHz) with electric power density of 0.5 to 0.8 W/cm$^2$. Good characteristics of the silicon oxide film thus manufactured as a gate insulating film can be obtained by subsequently performing thermal annealing at 400 to 500° C.

A first conductive film 5008 and a second conductive film 5009 are then formed on the gate insulating film 5007 in order to form gate electrodes. In Embodiment 3, the first conductive film 5008 is formed from Ta with a thickness of 50 to 100 nm, and the second conductive film 5009 is formed from W with a thickness of 100 to 300 nm.

The Ta film is formed by sputtering, and sputtering of a Ta target is performed by using Ar. If an appropriate amount of Xe or Kr is added to the Ar during sputtering, the internal stress of the Ta film will be relaxed, and film peeling can be prevented. The resistivity of a α phase Ta film is on the order of 20 μΩcm, and the Ta film can be used for the gate electrode, but the resistivity of a β phase Ta film is on the order of 180 μΩcm and the Ta film is unsuitable for the gate electrode. The α phase Ta film can easily be obtained if a tantalum nitride film, which possesses a crystal structure near that of phase Ta, is formed with a thickness of 10 to 50 nm as a base for Ta in order to form the phase Ta film.

The W film is formed by sputtering with W as a target. The W film can also be formed by a thermal CVD method using tungsten hexafluoride ($WF_6$). Whichever is used, it is necessary to make the film low resistant in order to use it as the gate electrode, and it is preferable that the resistivity of the W film be set 20 μΩcm or less. The resistivity can be lowered by enlarging the crystals of the W film, but for cases where there are many impurity elements such as oxygen within the W film, crystallization is inhibited, and the film becomes high resistant. A W target having a purity of 99.9999% is thus used in sputtering. In addition, by forming the W film while taking sufficient care such that no impurities from the inside of the gas phase are introduced at the time of film formation, a resistivity of 9 to 20 μΩcm can be achieved.

Note that although the first conductive film 5008 and the second conductive film 5009 are formed from Ta and W, respectively, in Embodiment 3, the conductive films are not limited to these. Both the first conductive film 5008 and the second conductive film 5009 may also be formed from an element selected from the group consisting of Ta, W, Ti, Mo, Al, and Cu, or from an alloy material or a chemical compound material having one of these elements as its main constituent. Further, a semiconductor film, typically a polysilicon film, into which an impurity element such as phosphorus is doped, may also be used. Examples of preferable combinations other than that in Embodiment 3 include: the first conductive film 5008 formed from tantalum nitride (TaN) and the second conductive film 5009 formed from W; the first conductive film 5008 formed from tantalum nitride (TaN) and the second conductive film 5009 formed from Al; and the first conductive film 5008 formed from tantalum nitride (TaN) and the second conductive film 5009 formed from Cu.

Next, a mask 5010 is formed from resist, and a first etching process is performed in order to form electrodes and wirings. An ICP (inductively coupled plasma) etching method is used in Embodiment 3. A gas mixture of $CF_4$ and $Cl_2$ is used as an etching gas, and plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. The W film and the Ta film are both etched on the same order when $CF_4$ and $Cl_2$ are mixed.

Edge portions of the first conductive layer and the second conductive layer are made into a tapered shape in accordance with the effect of the bias voltage applied to the substrate side with the above etching conditions by using a suitable resist mask shape. The angle of the tapered portions is from 15 to 45°. The etching time may be increased by approximately 10 to 20% in order to perform etching without any residue on the gate insulating film. The selectivity of a silicon oxynitride film with respect to a W film is from 2 to 4 (typically 3), and therefore approximately 20 to 50 nm of the exposed surface of the silicon oxynitride film is etched by this over-etching process. First shape conductive layers 5011 to 5016 (first conductive layers 5011*a* to 5016*a* and second conductive layers 5011*b* to 5016*b*) are thus formed of the first conductive layer and the second conductive layer by the first etching process. At this point, regions of the gate insulating film 5007 not covered by the first shape conductive layers 5011 to 5016 are made thinner by approximately 20 to 50 nm by etching (FIG. 10B).

Then, a first doping process is performed to add an impurity element for imparting an n-type conductivity. Doping may be carried out by an ion doping method or an ion implanting method. The condition of the ion doping method is that a dosage is $1\times10^{13}$ to $5\times10^{14}$ atoms/cm$^2$, and an acceleration voltage is 60 to 100 keV. As the impurity element for imparting the n-type conductivity, an element belonging to group 15, typically phosphorus (P) or arsenic (As) is used, but phosphorus is used here. In this case, the conductive layers 5011 to 5015 become masks to the impurity element to impart the n-type conductivity, and first impurity regions 5017 to 5025 are formed in a self-aligning manner. The impurity element to impart the n-type conductivity in the concentration range of $1\times10^{20}$ to $1\times10^{21}$ atoms/cm$^3$ is added to the first impurity regions 5017 to 5025 (FIG. 10B).

Next, as shown in FIG. 10C, a second etching process is performed without removing the mask formed from resist. The etching gas of the mixture of $CF_4$, $Cl_2$ and $O_2$ is used, and the W film is selectively etched. At this point, second shape conductive layers 5026 to 5031 (first conductive layers 5026*a* to 5031*a* and second conductive layers 5026*b* to 5031*b*) are formed by the second etching process. Regions of the gate insulating film 5007, which are not covered with the second shape conductive layers 5026 to 5031 are made thinner by about 20 to 50 nm by etching.

An etching reaction of the W film or the Ta film by the mixture gas of $CF_4$ and $Cl_2$ can be guessed from a generated radical or ion species and the vapor pressure of a reaction product. When the vapor pressures of fluoride and chloride of W and Ta are compared with each other, the vapor pressure of $WF_6$ of fluoride of W is extremely high, and other $WCl_5$, $TaF_5$, and $TaCl_5$ have almost equal vapor pressures. Thus, in the mixture gas of $CF_4$ and $Cl_2$, both the W film and the Ta film are etched. However, when a suitable amount of $O_2$ is added to this mixture gas, $CF_4$ and $O_2$ react with each other to form CO and F, and a large number of F radicals or F ions are generated. As a result, an etching rate of the W film having the high vapor pressure of fluoride is increased. On the other hand, with respect to Ta, even if F is increased, an increase of the etching rate is relatively small. Besides, since Ta is easily oxidized as compared with W, the surface of Ta is oxidized by addition of $O_2$. Since the oxide of Ta does not react with fluorine or chlorine, the etching rate of the Ta film is further decreased. Accordingly, it becomes possible to make a difference between the etching rates of the W film and the Ta film, and it becomes possible to make the etching rate of the W film higher than that of the Ta film.

Figure 11A:
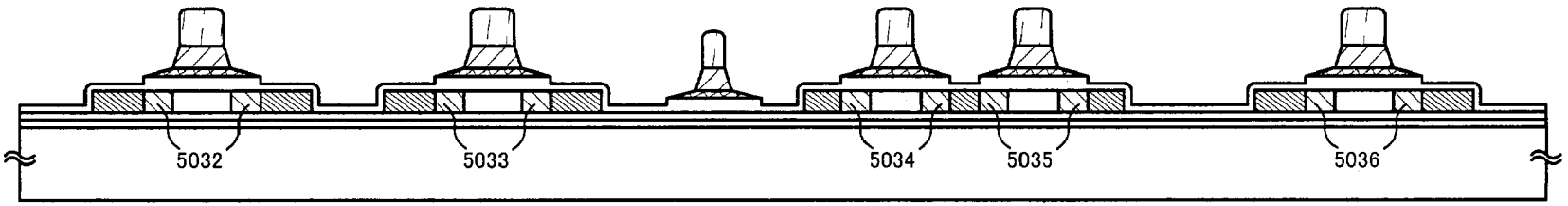
FIGS. 11A to 11C are views showing a manufacturing process of the liquid crystal display device of the invention.

Then, as shown in FIG. 11A, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG.

11B. Doping is carried out such that the second shape conductive layers 5026 to 5030 are used as masks to the impurity element and the impurity element is added also to the regions under the first conductive layers 5026*a* to 5030*a*. In this way, third impurity regions 5032 to 5036 are formed. The concentration of phosphorus (P) added to the third impurity regions 5032 to 5036 has a gentle concentration gradient in accordance with the thickness of tapered portions of the first conductive layers 5026*a* to 5030*a*. Note that in the semiconductor layer that overlap with the tapered portions of the first conductive layers 5026*a* to 5030*a*, the concentration of impurity element slightly falls from the end portions of the tapered portions of the first conductive layers 5026*a* to 5030*a* toward the inner portions, but the concentration keeps almost the same level.

Figure 11B:
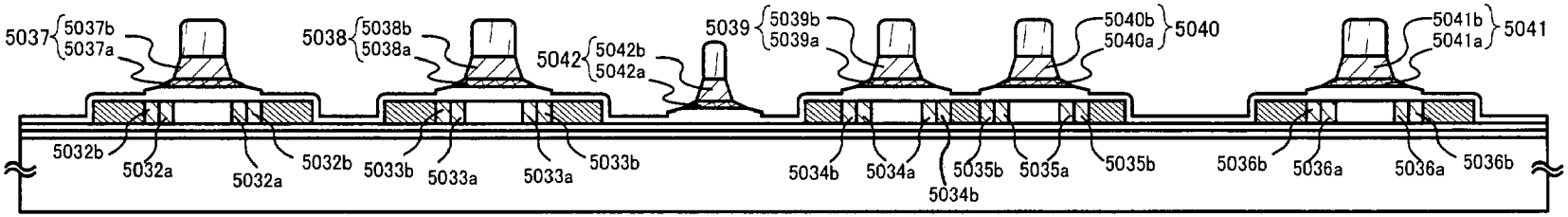

As shown in FIG. 11B, a third etching process is performed. This is performed by using a reactive ion etching method (RIE method) with an etching gas of $CHF_6$. The tapered portions of the first conductive layers 5026*a* to 5031*a* are partially etched, and the region in which the first conductive layers overlap with the semiconductor layer is reduced by the third etching process. Third shape conductive layers 5037 to 5042 (first conductive layers 5037*a* to 5042*a* and second conductive layers 5037*b* to 5042*b*) are formed. At this point, regions of the gate insulating film 5007, which are not covered with the third shape conductive layers 5037 to 5042 are made thinner by about 20 to 50 nm by etching.

By the third etching process, in third impurity regions 5032 to 5036, third impurity regions 5032*a* to 5036*a*, which overlap with the first conductive layers 5037*a* to 5041*a*, and second impurity regions 5032*b* to 5236*b* between the first impurity regions and the third impurity regions are formed.

Figure 11C:
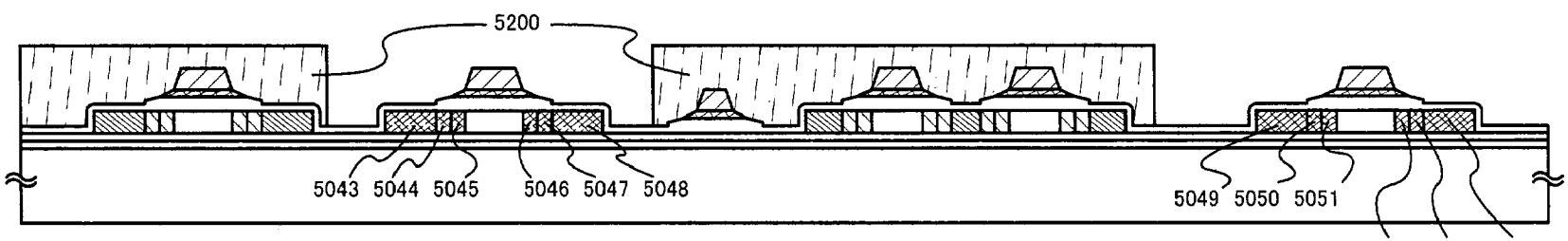

Then, as shown in FIG. 11C, fourth impurity regions 5043 to 5054 having a conductivity type opposite to the first conductivity type are formed in the island-like semiconductor layers 5004, 5006 for forming p-channel TFTs. The third conductive layer 5038*b*, 5041*b* is used as masks to an impurity element, and the impurity regions are formed in a self-aligning manner. At this time, the whole surfaces of the island-like semiconductor layers 5003, 5005, and the conductive layer 5042, which form n-channel TFTs are covered with a resist mask 5200. Phosphorus is added to the impurity regions 5043 to 5054 at different concentrations, respectively. The regions are formed by an ion doping method using diborane ($B_2H_6$) and the impurity concentration is made $2\times10^{20}$ to $2\times10^{21}$ atoms/cm$^3$ in any of the regions.

By the steps up to this, the impurity regions are formed in the respective island-like semiconductor layers. The third shape conductive layers 5037 to 5041 overlapping with the island-like semiconductor layers function as gate electrodes. The conductive layer 5042 functions as an island-like source signal line.

After the resist mask 5200 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Embodiment 3, a heat treatment is conducted at 500° C. for 4 hours. However, in the case where a wiring material used for the third conductive layers 5037 to 5042 are weak to heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Figure 12A:
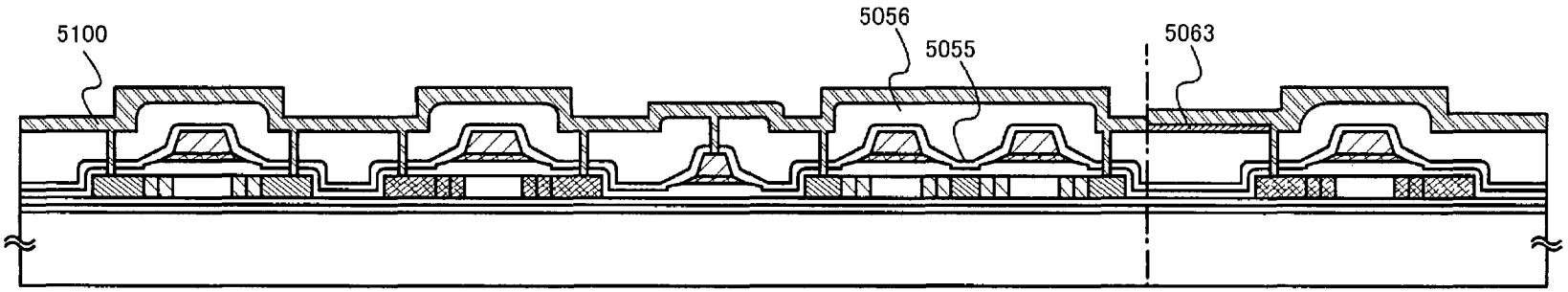
FIGS. 12A and 12B are views showing a manufacturing process of the liquid crystal display device of the invention.

Next, as shown in FIG. 12A, a first interlayer insulating film 5055 having a thickness of 100 to 200 nm is formed of a silicon oxynitride film. A second interlayer insulating film 5056 made of an organic insulating material is formed thereon.

Next, the film made from organic resin is used for the second interlayer insulating film 5056. As the organic resin, polyimide, polyamide, acryl, BCB (benzocyclobutene) or the like can be used. Especially, since the second interlayer insulating film 5056 has rather the meaning of flattening, acryl is desirable in flatness. In Embodiment 3, an acryl film is formed to such a thickness that stepped portions formed by the TFTs can be adequately flattened. The thickness is preferably made 1 to 5 μm (more preferably 2 to 4 μm).

Contact holes reaching the first interlayer insulating film 5055, the second interlayer insulating film 5056, and the gate insulating film 5007 are formed.

In the formation of the contact holes, dry etching or wet etching is used, and contact holes reaching the n-type impurity regions 5017, 5018, 5021, and 5023, or the p-type impurity regions 5043, 5048, 5049, or 5054, a contact hole reaching the source wiring 5042, and contact holes reaching the gate electrodes (not shown) are formed, respectively.

Then, ITO film is formed to have a thickness of 110 nm as the pixel electrode 5063, and then patterning is carried out thereon. As the electrode, such as a transparent conductive film obtained by mixing 2 to 20% of zinc oxide (ZnO) with indium oxide may be used (FIG. 12A).

And then, S/D metal layer 5100 is formed. In this embodiment, as the S/D metal layer 5100, the film stack having three layers are used, which is sequentially stacked a titanium film, a titanium nitride film, and an aluminum film by using a sputtering. Of course, another conductive film may also be used.

Figure 12B:
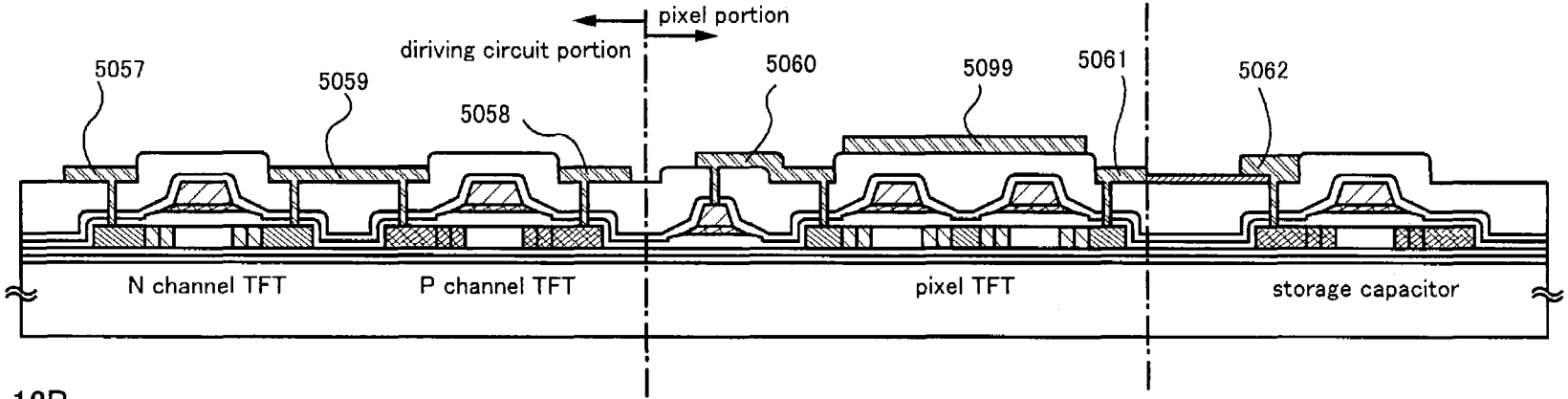

Next, as shown in FIG. 12B, the S/D metal layer 5100 is patterned, and each wiring (connecting wiring, a signal wiring are included) 5057 to 5062, 5099 are formed.

As shown in FIG. 12B, the drain wiring 5061 and the connection wiring 5062 are formed to overlap with the pixel electrode 5063 in order to contact with the pixel electrode 5063.

According to this, TFT of the driving circuit portion, TFT of the pixel portion, and the storage capacitor are completed. In this specification, such substrate is referred to as "active matrix substrate" as a matter of convenience.

In this embodiment, the manufacturing method of the transparent active matrix type liquid display device is described, however the reflective active matrix type liquid display device may be formed by the same method.

Embodiment 4

Figure 13:
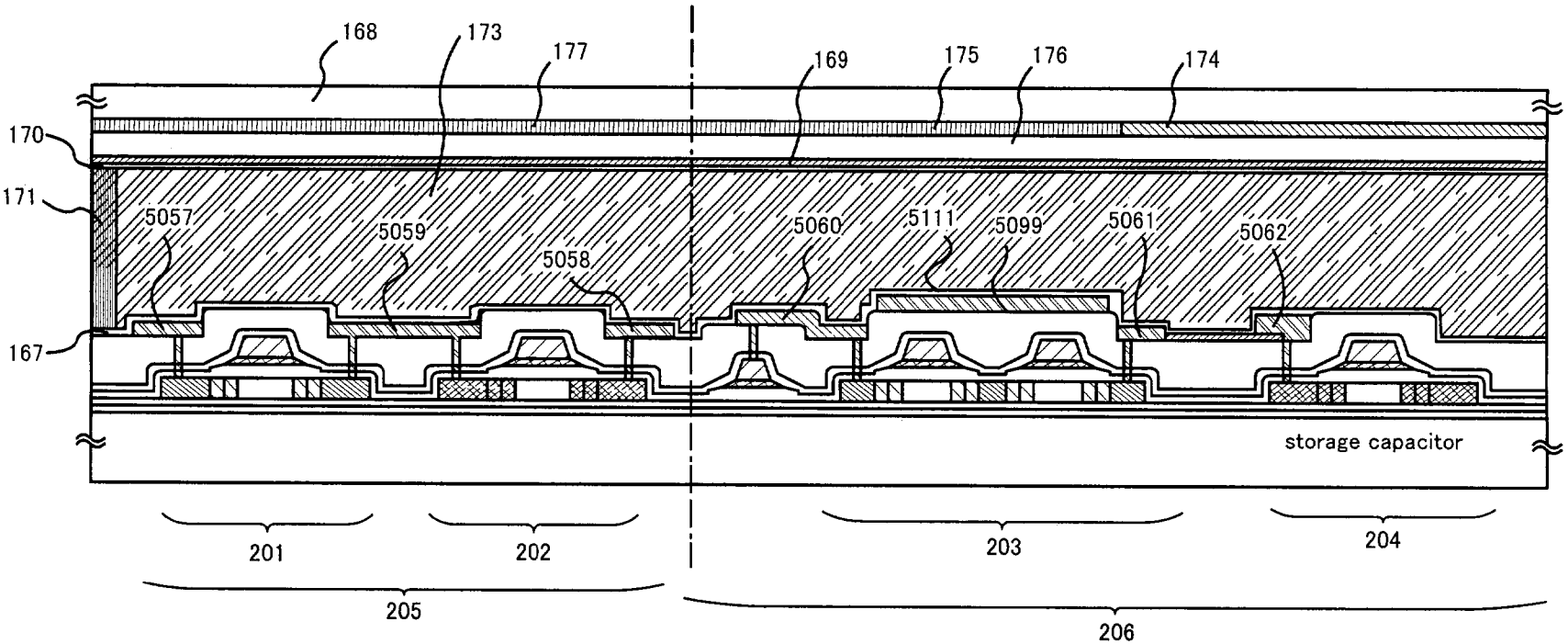
FIG. 13 is a view showing a manufacturing process of the liquid crystal display device of the invention.

In this embodiment, the manufacturing process of an active matrix liquid crystal display device from the active matrix substrate manufactured in Embodiment 3 is described below. FIG. 13 is used for explanation.

The active matrix substrate in a state shown in FIG. 12B is obtained, thereafter, an alignment film 167 is formed on the active matrix substrate of FIG. 12B, and is subjected to a rubbing process. The alignment film 167 is preferred to be formed to have a thickness of 500 to 1500 Å. In this embodiment, the film is formed to have a thickness of 700 Å.

Note that, in this embodiment, before the formation of the alignment film 167, a columnar spacer for maintaining a gap between the substrates is formed at a desired position by patterning an organic resin film such as an acrylic resin film. Further, spherical spacers may be scattered on the entire surface of the substrate in place of the columnar spacer.

Next, an opposing substrate 168 is prepared. On the opposing substrate 168, there are formed a colored layers 174, a light shielding layer 175 and color filters arranged to correspond to the respective pixels. Further, the driving circuit portion is also provided with a light shielding layer 177. A leveling film 176 is provided to cover the color filters and the light shielding layer 177. Next, in the pixel portion an opposing electrode 169 is formed from a transparent conductive film on the leveling film 176, an alignment film 170 is formed on the entire surface of the opposing substrate 168, and a rubbing process is conducted thereon. The alignment film 170 is preferred to be formed to have a thickness of 500 to 1500 Å. In this embodiment, the film is formed to have a thickness of 700 Å.

Then, the active matrix substrate on which a pixel portion and a driving circuit are formed is stuck with the opposing substrate by a sealing agent 171. A filler is mixed in the sealing agent 171, and the two substrates are stuck with each other while keeping a uniform gap by this filler and the columnar spacer. Thereafter, a liquid crystal material 173 is injected between both the substrates to encapsulate the substrates completely by an encapsulant (not shown). A known liquid crystal material may be used as the liquid crystal material 173. Thus, the active matrix liquid crystal display device shown in FIG. 13 is completed. Then, if necessary, the active matrix substrate and the opposing substrate are parted into desired shapes. In addition, by using a known technique, a polarizing plate or the like may be suitably provided.

Figure 15:
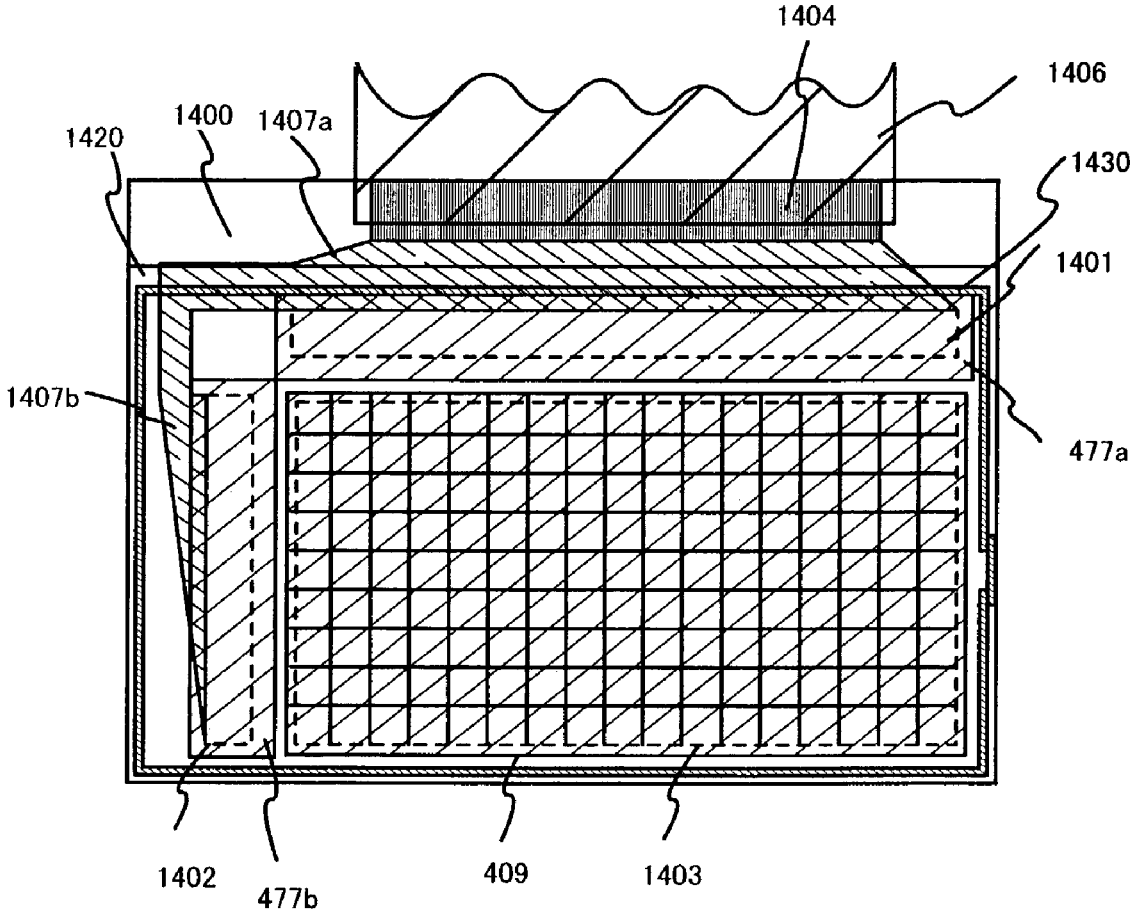
FIG. 15 is a top view of the liquid crystal display device of the invention.

The structure of the liquid crystal display panel obtained in this way is described using the top view of FIG. 15.

In the top view shown in FIG. 15, the active matrix substrate provided with an external input terminal 1404 for adhering the pixel portion 1403, the source signal line driving circuit 1401, the gate signal line driving circuit 1402, and the FPC terminal 1406, wirings 1407*a*, 1407*b* connecting the external input terminal to the input portion of each circuit, and the like, and the opposing substrate 1420 provided with color filters and the like are adhered by the sealing agent 1430.

A light shielding layer 477*a* is provided on the opposing substrate side overlapping with a source signal line driving circuit 1401, and a light shielding layer 477*b* is provided on the opposing substrate side overlapping with a gate signal line driving circuit 1402. Further, a color filter 409 provided on the opposing substrate side on the pixel portion 1403 is provided with the light shielding layer and the respective colored layers of each color of red (R), green (G), and blue (B) corresponding to each pixel. When display is actually performed, color display is performed with the three colors of the red-colored (R) layer, the green-colored (G) layer, and the blue-colored (B) layer. The arrangement of the colored layers of respective colors may be arbitrary.

The color filter 409 is provided on the opposing substrate for color, but it is not particularly limited thereto, and when manufacturing the active matrix substrate, a color filter may be formed on the active matrix substrate.

Further, a light shielding layer is provided between the adjacent pixels in the color filter, and portions other than the display region is shielded from light. Further, light shielding layers 477*a* and 477*b* are provided in regions covering the driving circuit, but the regions covering the driving circuit are covered when the liquid crystal display device is later incorporated as a display portion of electric appliances, so that the structure may be such that a light shielding layer is not particularly provided. Further, when manufacturing the active matrix substrate, a light shielding layer may be formed on the active matrix substrate.

Further, the portions other than the display region (gaps between pixel electrodes) and the driving circuit may be shielded from light without providing the light shielding layers and with suitably arranging a lamination of a plurality of colored layers, constituting the color filter, between the opposing substrate and the opposing electrode.

The liquid crystal display device is completed by this means.

In this embodiment, the manufacturing method of the transparent active matrix type liquid display device is described, however the reflective active matrix type liquid display device may be formed by the same method.

Embodiment 5

The liquid crystal display device formed according to Embodiments 3, 4 can comprise a liquid crystal module. And the liquid crystal display device can be used as display portions of various electronic appliances. Such electronic appliances incorporated the liquid crystal display devices formed according to the present invention as display medium are described as follows.

Such electronic appliances may be a video camera, a digital camera, a head-mount type of display (goggle type of display), a game machine, a car navigation apparatus, a personal computer and a portable information terminal (such as a mobile computer, a portable phone and an electronic book). FIGS. 18A through 18E illustrate examples of the above.

Figure 18A:
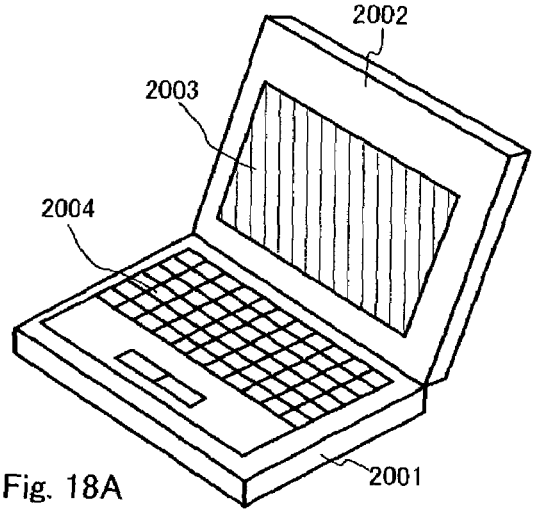
FIGS. 18A to 18E show electronic apparatuses using the liquid crystal display device of the invention.

FIG. 18A illustrates a personal computer comprising a main body 2001, a supporting stand 2002, a display portion 2003, and a key board 2004. The liquid crystal display device according to the present invention is used to the display portion 2003 of the personal computer.

Figure 18B:
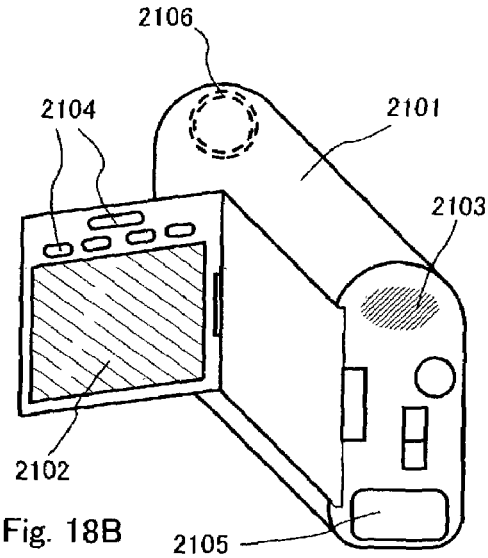

FIG. 18B illustrates a video camera comprising a body 2101, a display portion 2102, a sound inputting portion 2103, an operation switch 2104, a battery 2105 and a receiving portion 2106. The liquid crystal display device according to the present invention may be used to the display portion 2102 of the video camera.

Figure 18C:
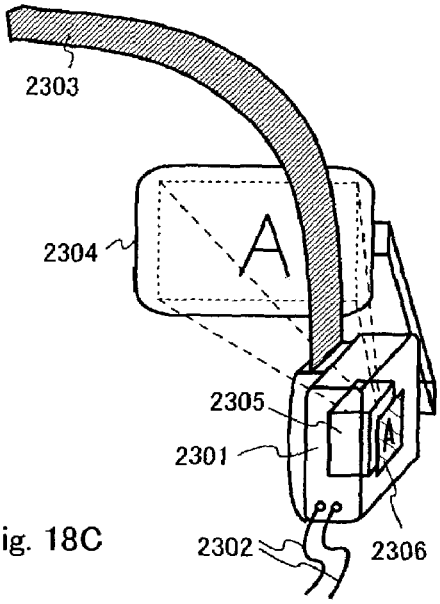

FIG. 18C illustrates a part (only the right side) of a head-mount type display device comprising a body 2301, a signal cable 2302, a head fixing band 2303, a display monitor 2304, an optical system 2305 and a display portion 2306. The liquid crystal display device according to the present invention may be used to the display portion 2306 of the head-mount type of liquid crystal display device.

Figure 18D:
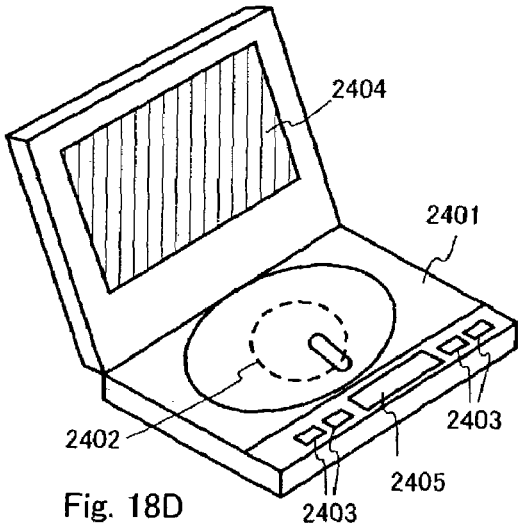

FIG. 18D illustrates an image playback apparatus provided with a storing medium (concretely, a DVD playback apparatus) comprising a main body 2401, a storing medium (CD, LD, DVD, or the like) 2402, an operation switch 2403, a display portion (a) 2404 and display portion (b) 2405. The display portion (b) is mainly displaying a image information, and the display portion (a) is mainly displaying character information. The liquid crystal display device according to the present invention may be used to the display portion (a), (b) of the image playback apparatus provided with a storing medium. The present invention may be used to a CD reproducing apparatus, and a game apparatus as the image reproducing apparatus comprising a storing medium.

Figure 18E:
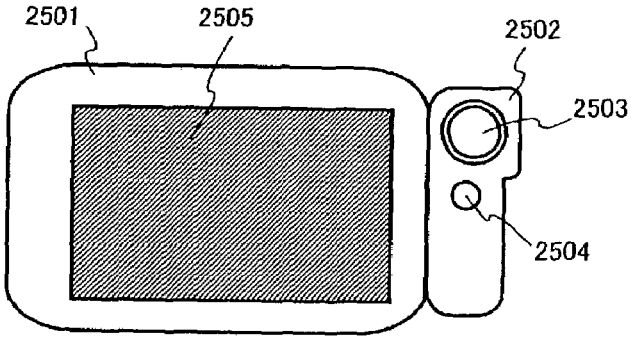

FIG. 18E illustrates a portable (mobile) computer comprising a body 2501, a camera portion 2502, an image receiving portion 2503, operation switches 2504, and a display portion 2505. The liquid crystal display device according to the present invention may be used to the display portion 2505 of the portable (mobile) computer.

As described above, an application range of the invention is so wide that the invention can be applied to electronic appliance in various fields. The electronic appliance in this embodiment can be provided in a structure of any combination of Embodiments 1 to 4.

In the conventional liquid crystal display device of the inverse-cross structure, since a gate signal line is in contact with an orientation film directly, there is a problem in that a liquid crystal is deteriorated by a signal voltage applied to the gate signal line.

The invention can reduce influence of a direct current voltage on a gate signal line to a liquid crystal and prevent deterioration of the liquid crystal.

What is claimed is:

1. A liquid crystal display device comprising:
a source signal line over a substrate;
a gate signal line over the substrate;
a source signal line driving circuit;
a gate signal line driving circuit; and
a pixel over the substrate, the pixel comprising:
a pixel electrode;
a counter electrode;
a thin film transistor, wherein a gate electrode of the thin film transistor is connected to the gate signal line, one of drain and source regions of the thin film transistor is connected to the source signal line, and the other is connected to the pixel electrode; and
a liquid crystal portion provided between the pixel electrode and the counter electrode, the liquid crystal portion comprising:
a first orientation film;
a second orientation film; and
a liquid crystal provided between the first orientation film and the second orientation film,
wherein the pixel electrode and the gate signal line are formed on the same insulating surface,
wherein the liquid crystal is provided over the pixel electrode and the gate signal line,
wherein a first voltage is applied to the gate signal line at a gate signal line selecting period in a frame period in a time of display, a second voltage is applied to the gate signal line at a gate signal line non-selecting period in the frame period in the time of display, and a third voltage having the same polarity with the first voltage is applied to the gate signal line in an entire frame period in a time of non-display, and
wherein a clock pulse supplied to the source signal line driving circuit and the gate signal line driving circuit is stopped during the time of non-display.

2. A liquid crystal display device according to claim 1, wherein the liquid crystal display device comprises a source signal line driving circuit and a gate signal line driving circuit, a start pulse supplied to the source signal line driving circuit and the gate signal line driving circuit is fixed to Hi or Lo during the time of non-display.

3. A liquid crystal display device according to claim 1, wherein during the time of non-display, an inverse voltage of the second voltage is applied with an inverse duty of a duty in the time of display.

4. A liquid crystal display device according to claim 1, wherein a material of the liquid crystal is a cyanic liquid crystal.

5. A liquid crystal display device according to claim 1, wherein the liquid crystal display device is incorporated in to an electronic apparatus selected from the group consisting of a personal computer, a video camera, a head-mount type display device, an image playback apparatus, and a portable computer.

6. A liquid crystal display device according to claim 1, wherein the time of non-display is a backlight off period, a period in which whole black display is performed, or a period in which whole white display is performed.

7. A liquid crystal display device according to claim 1, wherein the third voltage having the same polarity as the first voltage is applied to the gate signal line during entirety of the time of non-display.

8. A liquid crystal display device comprising:
a source signal line over a substrate;
a gate signal line over the substrate;
a source signal line driving circuit;
gate signal line driving circuit; and
a pixel over the substrate, the pixel comprising:
a pixel electrode;
a counter electrode;
a source wiring;
a drain wiring; and
a thin film transistor, wherein a gate electrode of the thin film transistor is connected to the gate signal line, one of drain and source regions of the thin film transistor is connected to the source signal line through the source wiring, and the other is connected to the pixel electrode through the drain wiring; and
a liquid crystal portion provided between the pixel electrode and the counter electrode, the liquid crystal portion comprising:
a first orientation film;
a second orientation film; and
a liquid crystal provided between the first orientation film and the second orientation film,
wherein the pixel electrode, the gate signal line, the source wiring, and the drain wiring are formed on the same insulating surface,
wherein the liquid crystal is provided over the pixel electrode, the gate signal line, the source wiring, and the drain wiring,
wherein the drain wiring is provided over the source signal line,
wherein a first voltage is applied to the gate signal line at a gate signal line selecting period in a frame period in a time of display, a second voltage is applied to the gate signal line at a gate signal line non-selecting period in the frame period in the time of display, and a third voltage having the same polarity with the first voltage is applied to the gate signal line in an entire flame period in a time of non-display, and
wherein a clock pulse supplied to the source signal line driving circuit and the gate signal line driving circuit is stopped during the time of non-display.

9. A liquid crystal display device according to claim 1, wherein the liquid crystal display device comprises a source signal line driving circuit and a gate signal line driving circuit, a start pulse supplied to the source signal line driving circuit and the gate signal line driving circuit is fixed to Hi or Lo during the time of non-display.

10. A liquid crystal display device according to claim 8, wherein during the time of non-display, an inverse voltage of the second voltage is applied with an inverse duty of a duty in the time of display.

11. A liquid crystal display device according to claim 8, wherein a material of the liquid crystal is a cyanic liquid crystal.

12. A liquid crystal display device according to claim 8, wherein the liquid crystal display device is incorporated in to an electronic apparatus selected from the group consisting of a personal computer, a video camera, a head-mount type display device, an image playback apparatus, and a portable computer.

13. A liquid crystal display device according to claim 8, wherein the time of non-display is a backlight off period, a period in which whole black display is performed, or a period in which whole white display is performed.

14. A liquid crystal display device according to claim 8, wherein the third voltage having the same polarity as the first voltage is applied to the gate signal line during entirety of the time of non-display.

15. A liquid crystal display device comprising:

a source signal line on a substrate;

first and second gate signal lines over the substrate, the first and second gate signal lines adjoining each other;

a source signal line driving circuit;

a gate signal line driving circuit; and a pixel on the substrate, the pixel comprising:

a pixel electrode;

a counter electrode;

a thin film transistor, wherein a gate electrode of thin film transistor is connected to one of the gate signal lines, one of drain and source regions of the thin film transistor is connected to the source signal line, and the other is connected so the pixel electrode; and a liquid crystal portion provided between the pixel electrode and the counter electrode, the liquid crystal portion comprising:

a first orientation film;

a second orientation film;

a liquid crystal provided between the first orientation film and the second orientation film, wherein the pixel electrode and the gate signal lines are formed on the same insulating surface, wherein the liquid crystal is provided over the pixel electrode and the first and second gate signal lines, wherein the first and second gate signal lines are selected simultaneously during at least two or more line periods, and wherein a clock pulse supplied to the source signal line driving circuit and the gate signal line driving circuit is stopped during a time of non-display.

16. A liquid crystal display device according to claim 15, wherein the first and second gate signal lines are selected simultaneously during five to twenty line periods.

17. A liquid crystal display device according to claim 15, wherein a material of the liquid crystal is a cyanic liquid crystal.

18. A liquid crystal display device according to claim 15, wherein the liquid crystal display device is incorporated in to an electronic apparatus selected from the group consisting of a personal computer, a video camera, a head-mount type display device, an image playback apparatus, and a portable computer.

19. A liquid crystal display device comprising:

a source signal line over a substrate;

first and second gate signal lines over the substrate, the first and second gate signal lines adjoining each other;

a source signal line driving circuit;

a gate signal line driving circuit; and a pixel over the substrate, the pixel comprising:

a pixel electrode;

a counter electrode;

a source wiring;

a drain wiring;

a thin film transistor, wherein a gate electrode of the thin film transistor is connected to one of the gate signal lines, one of drain and source regions of the thin film transistor is connected to the source signal line through the source wiring and the other is connected to the pixel electrode through the drain wiring; and a liquid crystal portion provided between the pixel electrode and the counter electrode, the liquid crystal portion comprising:

a first orientation film;

a second orientation film; and a liquid crystal provided between the first orientation film and the second orientation film, wherein the pixel electrode, the gate signal lines, the source wiring, and the drain wiring are formed on the same insulating surface, wherein the liquid crystal is provided over the pixel electrode, the first and second gate signal lines, the source wiring, and the drain wiring, and wherein the first and second gate signal lines are selected simultaneously during at least two or more line periods, and wherein a clock pulse supplied to the source signal line driving circuit and the gate signal line driving circuit is stopped during a time of non-display.

20. A liquid crystal display device according to claim 19, wherein the first and second gate signal lines are selected simultaneously during five to twenty line periods.

21. A liquid crystal display device according to claim 19, wherein a material of the liquid crystal is a cyanic liquid crystal.

22. A liquid crystal display device according to claim 19, wherein the liquid crystal display device is incorporated in to an electronic apparatus selected from the group consisting of a personal computer, a video camera, a head-mount type display device, an image playback apparatus, and a portable computer.

23. A liquid crystal display device comprising:

a source signal line over a substrate;

first and second gate signal lines over the substrate, the first and second gate signal lines adjoining each other;

a source signal line driving circuit;

a gate signal line driving circuit; and a pixel over the substrate, the pixel comprising:

a pixel electrode;

a counter electrode;

a thin film transistor, wherein a gate electrode of the thin film transistor is connected to one of the gate signal lines, one of drain and source regions of the thin film transistor is connected to the source signal line, and the other is connected to the pixel electrode; and a liquid crystal portion provided between the pixel electrode and the counter electrode, the liquid crystal portion comprising:

a first orientation film;

a second orientation film;

a liquid crystal provided between the first orientation film and the second orientation film, wherein the pixel electrode and the first and second gate signal lines are formed on the same insulating surface, wherein the liquid crystal is provided over the pixel electrode and the first and second gate signal lines, wherein the first and second gate signal lines are selected simultaneously during at least two or more line periods, wherein a first voltage is applied to the first and second gate signal lines at a gate signal line selecting period in a frame period in a time of display, a second voltage is applied to the first and second gate signal lines at a gate signal line non-selecting period in the frame period in the time of display, and a third voltage having the same polarity with the first voltage is applied to the first and second gate signal lines in an entire frame period in a time of non-display, and wherein a clock pulse supplied to the source signal line driving circuit and the gate signal line driving circuit is stooped during the time of non-display.

24. A liquid crystal display device according to claim 23, wherein the liquid crystal display device comprises a source signal line driving circuit and a gate signal line driving circuit, and a start pulse supplied to the source signal line driving circuit and the gate signal line driving circuit is fixed to Hi or Lo during the time of non-display.

25. A liquid crystal display device according to claim 23, wherein during the time of non-display, an inverse voltage of the second voltage is applied with an inverse duty of a duty in the time of display.

26. A liquid crystal display device according to claim 23, wherein the first and second gate signal lines are selected simultaneously during five to twenty line periods.

27. A liquid crystal display device according to claim 23, wherein a material of the liquid crystal is a cyanic liquid crystal.

28. A liquid crystal display device according to claim 23, wherein the liquid crystal display device is incorporated in to an electronic apparatus selected from the group consisting of a personal computer, a video camera, a head-mount type display device, an image playback apparatus, and a portable computer.

29. A liquid crystal display device according to claim 23, wherein the time of non-display is a backlight off period, a period in which whole black display is performed, or a period in which whole white display is performed.

30. A liquid crystal display device according to claim 23, wherein the third voltage having the same polarity as the first voltage is applied to the gate signal line during entirety of the time of non-display.

31. A liquid crystal display device comprising:

a source signal line over a substrate;

first and second gate signal lines over the substrate, the first and second gate signal lines adjoining each other;

a source signal line driving circuit;

a gate signal line driving circuit; and a pixel over the substrate, the pixel comprising:

a pixel electrode;

a counter electrode;

a source wiring;

a drain wiring;

a thin film transistor, wherein a gate electrode of the thin film transistor is connected to the gate signal lines, one of drain and source regions of the thin film transistor is connected to the source signal line though the source wiring, and the other is connected to the pixel electrode through the drain wiring; and a liquid crystal portion provided between the pixel electrode and the counter electrode, the liquid crystal portion comprising:

a first orientation film;

a second orientation film; and a liquid crystal provided between the first orientation film and the second orientation film, wherein the pixel electrode, the first and second gate signal lines, the source wiring, and the drain wiring are formed on the same insulating surface, wherein the liquid crystal is provided over the pixel electrode, the first and second gate signal lines, the source wiring, and the drain wiring, wherein the first and second gate signal lines are selected simultaneously during at least two or more line periods, wherein a first voltage is applied to the first and second gate signal lines at a gate signal line selecting period in a frame period in a time of display, a second voltage is applied to the first and second gate signal lines at a gate signal line non-selecting period in the frame period in the time of display, and a third voltage having the same polarity with the first voltage is applied to the first and second gate signal lines in an entire frame period in a time of non-display, and wherein a clock poise supplied to the source signal line driving circuit and the gate signal line driving circuit is stopped during the time of non-display.

32. A liquid crystal display device according to claim 31, wherein the liquid crystal display device comprises a source signal line driving circuit and a gate signal line driving circuit, and a start pulse supplied to the source signal line driving circuit and the gate signal line driving circuit is fixed to Hi or Lo during the time of non-display.

33. A liquid crystal display device according to claim 31, wherein during the rime of non-display, an inverse voltage of the second voltage is applied with an inverse duty of a duty in the time of display.

34. A liquid crystal display device according to claim 31, wherein the first and second gate signal lines are selected simultaneously during five to twenty line periods.

35. A liquid crystal display device according to claim 31, wherein a material of the liquid crystal is a cyanic liquid crystal.

36. A liquid crystal display device according to claim 31, wherein the liquid crystal display device is incorporated in to an electronic apparatus selected from the group consisting of a personal computer, a video camera, a head-mount type display device, an image playback apparatus, and a portable computer.

37. A liquid crystal display device according to claim 31, wherein the time of non-display is a backlight off period, a period in which whole black display is performed, or a period in which whole white display is performed.

38. A liquid crystal display device according to claim 31, wherein the third voltage having the same polarity as the first voltage is applied to the gate signal line during entirety of the time of non-display.

39. A method of driving a liquid crystal display device, the liquid crystal display device comprising:

a source signal line over a substrate;

a gate signal line over the substrate;

a source signal line driving circuit;
a gate signal line driving circuit;
a thin film transistor over the substrate;
a pixel electrode over the thin film transistor, the pixel electrode being connected to the thin film transistor; and
a liquid crystal over the pixel electrode and the gate signal line,
wherein the pixel electrode and the gate signal line are formed on the same insulating surface,
the method comprising;
applying a first voltage to the gate signal line at a gate signal line selecting period in a frame period in a time of display;
applying a second voltage to the gate signal line at a gate signal line non-selecting period in the frame period in the time of display; and
applying a third voltage having the same polarity with the first voltage to the gate signal line in an entire frame period in a time of non-display,
wherein a clock pulse supplied to the source signal line driving circuit and the gate signal line driving circuit is stopped during the time of non-display.

40. A driving method according to claim 39, wherein the liquid crystal display device comprises a source signal line driving circuit and a gate signal line driving circuit, and a start pulse supplied to the source signal line driving circuit and the gate signal line driving circuit is fixed to Hi or Lo during the time of non-display.

41. A driving method according to claim 39, wherein during the time of non-display, an inverse voltage of the second voltage is applied with an inverse duty of a duty in the time of display.

42. A driving method according to claim 39, wherein a material of the liquid crystal is a cyanic liquid crystal.

43. A driving method according to claim 39, wherein the liquid crystal display device is incorporated in to an electronic apparatus selected from the group consisting of a personal computer, a video camera, a head-mount type display device, an image playback apparatus, and a portable computer.

44. A driving method according to claim 39, wherein the time of non-display is a backlight off period, a period in which whole black display is performed, or a period in which whole white display is performed.

45. A liquid crystal display device according to claim 39, wherein the third voltage having the same polarity as the first voltage is applied to the gate signal line during entirety of the time of non-display.

46. A method of driving a liquid crystal display device, the liquid crystal display device comprising:
a source signal line over a substrate;
a gate signal line over the substrate;
a source signal line driving circuit;
a gate signal line driving circuit;
a thin film transistor over the substrate; and
a pixel electrode over the thin film transistor, wherein a gate electrode of the thin film transistor is connected to the gate signal line, one of drain and source regions of the thin film transistor is connected to the source signal line through a source wining, and the other is connected to the pixel electrode through a drain wiring;
a liquid crystal over the pixel electrode, the gate signal line, the source wiring, and the drain wiring, and
wherein the pixel electrode, the gate signal line, the source wiring, and the drain wiring are formed on the same insulating surface,
the method comprising:
applying a first voltage to the gate signal line at a gate signal line selecting period in a frame period in a time of display;
applying a second voltage to the gate signal line at a gate signal line non-selecting period in the frame period in the time of display; and
applying a third voltage having the same polarity with the first voltage to the gate signal line in an entire frame period in a time of non-display,
wherein a clock pulse supplied to the source signal line driving circuit and the gate signal line driving circuit is stopped during the time of non-display.

47. A driving method according to claim 46, wherein the liquid crystal display device comprises a source signal line driving circuit and a gate signal line driving circuit, and a start pulse supplied to the source signal line driving circuit and the gate signal line driving circuit is fixed to Hi or Lo during the time of non-display.

48. A driving method according to claim 46, wherein during the time of non-display, an inverse voltage of the second voltage is applied with an inverse duty of a duty in the time of display.

49. A driving method according to claim 46, wherein a material of the liquid crystal is a cyanic liquid crystal.

50. A driving method according to claim 46, wherein the liquid crystal display device is incorporated in to an electronic apparatus selected from the group consisting of a personal computer, a video camera, a head-mount type display device, an image playback apparatus, and a portable computer.

51. A driving method according to claim 46, wherein the time of non-display is a backlight off period, a period in which whole black display is performed, or a period in which whole white display is performed.

52. A liquid crystal display device according to claim 46, wherein the third voltage having the same polarity as the first voltage is applied to the gate signal line during entirety of the time of non-display.

53. A method of driving a liquid crystal display device, the liquid crystal display device comprising:
a source signal line over a substrate;
a gate signal line over the substrate;
a source signal line driving circuit;
a gate signal line driving circuit;
a thin film transistor over the substrate;
a pixel electrode over the thin film transistor, the pixel electrode being connected to the thin film transistor; and
a liquid crystal over the pixel electrode and the gate signal line,
wherein the pixel electrode and the gate signal line are formed on the same insulating surface,
the method comprising:
applying a first voltage to the gate signal line at a gate signal line selecting period in a frame period in a time of display;
applying a second voltage to the gate signal line at a gate signal line non-selecting period in the frame period in the time of display; and
applying a third voltage having the same polarity with the first voltage to the gate signal line during a backlight off period, a period in which whole black display is performed, or a period in which whole white display is performed in an entire frame period in a time of non-display, wherein the first and second gate signal lines are selected simultaneously during at least two or more line periods, and wherein a clock pulse supplied to the source signal line driving circuit and the gate signal line driving circuit is stopped during the time of non-display.

54. A driving method according so claim 53, wherein the liquid crystal display device comprises a source signal line driving circuit and a gate signal line driving circuit, and a start pulse supplied to the source signal line driving circuit and the gate signal line driving circuit is fixed to Hi or Lo during the time of non-display.

55. A driving method according to claim 53, wherein during the time of non-display, an inverse voltage of she second voltage is applied with an inverse duty of a duty in the time of display.

56. A liquid crystal display device according to claim 53, wherein the first and second gate signal lines are selected simultaneously during five to twenty line periods.

57. A driving method according to claim 53, wherein a material of the liquid crystal is a cyanic liquid crystal.

58. A driving method according to claim 53, wherein the liquid crystal display device is incorporated in to an electronic apparatus selected from she group consisting of a personal computer, a video camera, a head-mount type display device, an image playback apparatus, and a portable computer.

59. A driving method according to claim 53, wherein the time of non-display is a backlight off period, a period in which whole black display is preformed, or a period in which whole white display is performed.

60. A driving method according to claim 53, wherein the third voltage having the same polarity as the first voltage is applied to the gate signal line during entirety of the time of non-display.

61. A method of driving a liquid crystal display device, the liquid crystal display device comprising:

a source signal line over a substrate;

a gate signal line over the substrate;

a source signal line driving circuit;

a gate signal line driving circuit;

a thin film transistor over the substrate;

a pixel electrode over the thin film transistor, wherein a gate electrode of the thin film transistor is connected to the gate signal line, one of drain and source regions of the thin film transistor is connected to the source signal line through a source wiring, and the other is connected to the pixel electrode through a drain wiring; and a liquid crystal over the pixel electrode, the gate signal line, the source wiring, and the drain wiring, and wherein the pixel electrode, the gate signal line, the source wiring, and the drain wiring are formed on the same insulating surface, the method comprising:

applying a first voltage to the gate signal line at a gate signal line selecting period in a frame period in a time of display;

applying a second voltage to the gate signal line at a gate signal line non-selecting period in the frame period in the time of display; and applying a third voltage having the same polarity with the first voltage to the gate signal line during a backlight off period, a period in which whole black display is performed, or a period in which whole white display is performed in an entire frame period in a time of non-display, wherein the first and second gate signal lines are selected simultaneously during at least two or more line periods, and wherein a clock pulse supplied to the source signal line driving circuit and the gate signal line driving circuit is stopped during the time of non-display.

62. A driving method according to claim 61, wherein the liquid crystal display device comprises a source signal line driving circuit and a gate signal line driving circuit, and a start pulse supplied to the source signal line driving circuit and the gate signal line driving circuit is fixed to Hi or Lo during the time of non-display.

63. A driving method according to claim 61, wherein during the time of non-display, an inverse voltage of the second voltage is applied with an inverse duty of a duty in the time of display.

64. A driving method according to claim 61, wherein the and second gate signal lines are selected simultaneously during five to twenty line periods.

65. A driving method according to claim 61, wherein a material of the liquid crystal is a cyanic liquid crystal.

66. A driving method according to claim 61, wherein the liquid crystal display device is incorporated in to an electronic apparatus selected from the group consisting of a personal computer, a video camera, a head-mount type display device, an image playback apparatus, and a portable computer.

67. A driving method according to claim 61, wherein the time of non-display is a backlight off period, a period in which whole black display is performed, or a period in which whole white display is performed.

68. A driving method according to claim 61, wherein the third voltage having the same polarity as the first voltage is applied to the gate signal line during entirety of the time of non-display.

* * * * *